US007806514B2

(12) United States Patent
Kadomatsu et al.

(10) Patent No.: US 7,806,514 B2
(45) Date of Patent: Oct. 5, 2010

(54) INKJET RECORDING APPARATUS

(75) Inventors: Tetsuzo Kadomatsu, Kanagawa-ken (JP); Yutaka Maeno, Kanagawa-ken (JP); Toshiyuki Makuta, Shizuoka-ken (JP); Tsutomu Umebayashi, Shizuoka-ken (JP)

(73) Assignee: Fujifilm Corporation, Tokyo (JP)

( * ) Notice: Subject to any disclaimer, the term of this patent is extended or adjusted under 35 U.S.C. 154(b) by 696 days.

(21) Appl. No.: 11/878,112

(22) Filed: Jul. 20, 2007

(65) Prior Publication Data

US 2008/0018695 A1 Jan. 24, 2008

(30) Foreign Application Priority Data

Jul. 24, 2006 (JP) ..... 2006-200835

(51) Int. Cl.
*B41J 2/14* (2006.01)

(52) U.S. Cl. ..... 347/52

(58) Field of Classification Search ..... 347/15, 347/43, 51–52, 95–96, 98, 100
See application file for complete search history.

(56) References Cited

U.S. PATENT DOCUMENTS 3,693,179 A * 9/1972 Skala ..... 347/52
5,781,210 A * 7/1998 Hirano et al. ..... 347/51
7,404,624 B2 * 7/2008 Sohn et al. ..... 347/52

FOREIGN PATENT DOCUMENTS

JP 2004-18656 A 1/2004
JP 2004-42465 A 2/2004

* cited by examiner

*Primary Examiner*—Lamson D Nguyen
(74) *Attorney, Agent, or Firm*—Birch, Stewart, Kolasch & Birch, LLP

(57) ABSTRACT

The inkjet recording apparatus which forms an image on a recording medium by applying a first liquid containing coloring material and a second liquid containing no coloring material or the coloring material of not greater than 0.1 wt %, on the recording medium, includes: a liquid application device which applies the second liquid on the recording medium and then ejects droplets of the first liquid toward the second liquid applied on the recording medium; and an electron beam irradiation device which radiates an electron beam on the first liquid and the second liquid on the recording medium, wherein: at least one of the first liquid and the second liquid contains a polymerizable compound which is polymerized when irradiated with the electron beam; and the electron beam irradiation device radiates the electron beam at an acceleration voltage of 40 kV through 60 kV.

6 Claims, 10 Drawing Sheets

FIG.8

| | | CURING RADIATION | ACCELERATION VOLTAGE | LIQUID B (TREATMENT LIQUID) | CURING CHARACTERISTICS | DEPOSITING INTERFERENCE | DOT EXPANSION | MOVEMENT OF GRAVITY CENTER OF DOT | EVALUATION |
|---|---|---|---|---|---|---|---|---|---|
| 1 | COMPARATIVE EXAMPLE | UV | - | NON-USE | GOOD | POOR | GOOD | POOR | POOR |
| 2 | COMPARATIVE EXAMPLE | UV | - | USE | GOOD | GOOD | POOR | POOR | POOR |
| 3 | COMPARATIVE EXAMPLE | EB | 30kV | NON-USE | AVERAGE | POOR | GOOD | POOR | POOR |
| 4 | COMPARATIVE EXAMPLE | EB | 40kV | NON-USE | GOOD | POOR | GOOD | POOR | POOR |
| 5 | COMPARATIVE EXAMPLE | EB | 50kV | NON-USE | GOOD | POOR | GOOD | POOR | POOR |
| 6 | COMPARATIVE EXAMPLE | EB | 60kV | NON-USE | GOOD | POOR | GOOD | POOR | POOR |
| 7 | COMPARATIVE EXAMPLE | EB | 65kV | NON-USE | GOOD | POOR | GOOD | POOR | POOR |
| 8 | COMPARATIVE EXAMPLE | EB | 70kV | NON-USE | GOOD | POOR | GOOD | POOR | POOR |
| 9 | COMPARATIVE EXAMPLE | EB | 30kV | USE | AVERAGE | GOOD | GOOD | GOOD | AVERAGE |
| 10 | PRACTICAL EXAMPLE | EB | 40kV | USE | GOOD | GOOD | GOOD | GOOD | GOOD |
| 11 | PRACTICAL EXAMPLE | EB | 50kV | USE | GOOD | GOOD | GOOD | GOOD | GOOD |
| 12 | PRACTICAL EXAMPLE | EB | 60kV | USE | GOOD | GOOD | GOOD | GOOD | GOOD |
| 13 | COMPARATIVE EXAMPLE | EB | 65kV | USE | GOOD | GOOD | AVERAGE | POOR | POOR |
| 14 | COMPARATIVE EXAMPLE | EB | 70kV | USE | GOOD | GOOD | POOR | POOR | POOR |

FIG.9

| | | SURFACE TENSION OF LIQUID A, $\gamma A$ (mN/m) | SURFACE TENSION OF LIQUID B, $\gamma B$ (mN/m) | CURING CHARACTERISTICS | DEPOSITING INTERFERENCE | DOT EXPANSION | MOVEMENT OF GRAVITY CENTER OF DOT | EVALUATION |
|---|---|---|---|---|---|---|---|---|
| 1 | COMPARATIVE EXAMPLE | 34.4(A1) | 36.3(B2) | GOOD | GOOD | POOR | GOOD | AVERAGE |
| 2 | PRACTICAL EXAMPLE | 34.4(A1) | 32.5(B3) | GOOD | GOOD | GOOD | GOOD | GOOD |
| 3 | PRACTICAL EXAMPLE | 34.4(A1) | 28.1(B4) | GOOD | GOOD | GOOD | GOOD | GOOD |
| 4 | COMPARATIVE EXAMPLE | 31.2(A2) | 36.3(B2) | GOOD | GOOD | POOR | GOOD | AVERAGE |
| 5 | COMPARATIVE EXAMPLE | 31.2(A2) | 32.5(B3) | GOOD | GOOD | POOR | GOOD | AVERAGE |
| 6 | PRACTICAL EXAMPLE | 31.2(A2) | 28.1(B4) | GOOD | GOOD | GOOD | GOOD | GOOD |

INKJET RECORDING APPARATUS

BACKGROUND OF THE INVENTION

1. Field of the Invention

The present invention relates to an inkjet recording apparatus of two-liquid type which records an image on a prescribed recording medium by using a first liquid containing a coloring material, and a second liquid containing no coloring material or a small amount of coloring material to prevent depositing interference.

2. Description of the Related Art

An inkjet recording apparatus of one-liquid type has been known, which uses an ink of radiation-curable type which is cured when irradiated with radiation, such as ultraviolet (UV) light, an electron beam (EB), or the like. Here, the electron beam (EB) is a flow of electrons imparted with a large energy by being accelerated by means of a high voltage.

Japanese Patent Application Publication Nos. 2004-18656 and 2004-42465 disclose that an ink of one-liquid type that contains a pigment and a radiation-polymerizable monomer, which is curable by irradiation of radiation, is cured by radiating an electron beam at an acceleration voltage of 10 kV to 150 kV, thereby implementing printing.

In the inkjet recording apparatus of one-liquid type which uses the radiation-curable ink, it is difficult to avoid depositing interference (i.e., coalescence of ink droplets on the recording medium). In view of these circumstances, an inkjet recording apparatus of two-liquid type has been developed. In the inkjet recording apparatus of two-liquid type, it is possible to prevent the depositing interference effectively in comparison with the inkjet recording apparatus of one-liquid type by depositing a liquid (hereinafter called "treatment liquid") containing no coloring material or containing a coloring material of 0.1% by weight (wt %) or less, on the recording medium, before depositing the ink liquid.

However, in the case where an ultraviolet light source (such as a metal halide lamp) is used as the radiation source for curing the ink, although it is possible to prevent the depositing interference as described above, ink dots are liable to float and move on a film of treatment liquid, and there may arise problems that: the gravity centers of the ink dots move due to the heating of the recording medium when irradiated with the ultraviolet light; the ink dots are unintentionally expanded; and consequently, the image quality is degraded due to the movement of the gravity center or the unintentional expansion of the ink dots. Moreover, it is required to sufficiently fix the image on the recording medium.

SUMMARY OF THE INVENTION

The present invention has been contrived in view of the aforementioned circumstances, an object thereof being to provide an inkjet recording apparatus which prevents the depositing interference between the ink droplets, while also being able to prevent the degradation of image quality caused by curing defects, the movement of the gravity center and the unintentional expansion of the ink dots.

In order to attain the aforementioned object, the present invention is directed to an inkjet recording apparatus which forms an image on a recording medium by applying a first liquid containing coloring material and a second liquid containing no coloring material or the coloring material of not greater than 0.1 wt %, on the recording medium, the inkjet recording apparatus comprising: a liquid application device which applies the second liquid on the recording medium and then ejects droplets of the first liquid toward the second liquid applied on the recording medium; and an electron beam irradiation device which radiates an electron beam on the first liquid and the second liquid on the recording medium, wherein: at least one of the first liquid and the second liquid contains a polymerizable compound which is polymerized when irradiated with the electron beam; and the electron beam irradiation device radiates the electron beam at an acceleration voltage of 40 kV through 60 kV.

In this case, the electron beam indicates a flow of electrons that is accelerated and imparted with energy by applying a high voltage. Moreover, the polymerizable compound indicates a compound which is subjected to a polymerization (or cross-linkage) reaction when irradiated with the electron beam.

The method of applying the first liquid on the recording medium is not limited in particular to droplet ejection, and the recording medium may also be coated with the first liquid.

In this aspect of the present invention, it is possible to prevent the degradation of image quality caused by curing defects, the movement of the gravity center and the unintentional expansion of the ink dots, while avoiding the depositing interference between the ink droplets by adopting the two-liquid system. Since the liquid application device deposits the first liquid (ink) containing coloring material in the form of droplets on the second liquid (treatment liquid) containing no coloring material or coloring material of not greater than 0.1 wt % that has been applied on the recording medium, then the coalescence of the deposited ink droplets on the recording medium is suppressed in comparison with the inkjet recording apparatus of one-liquid type. Since the polymerizable compound is cured by means of the electron beam radiated from the electron beam irradiation device, then it is possible to prevent the deterioration of image quality, such as the dot expansion or dot movement, or the like, caused by the effects of heat, in comparison with the case where the polymerizable compound is cured by the ultraviolet (UV) light. Since the acceleration voltage of the electron beam is 40 kV or greater, then the curing characteristics of the polymerizable compound are good and therefore it is possible to fix the coloring material on the recording medium, sufficiently. Moreover, since the acceleration voltage of the electron beam is no more than 60 kV, then it is possible to restrict heating of the recording medium, and therefore the degradation of image quality due to the effects of heat can prevented.

In order to attain the aforementioned object, the present invention is also directed to an inkjet recording apparatus which forms a transfer image on an intermediate transfer body by applying a first liquid containing coloring material and a second liquid containing no coloring material or the coloring material of not greater than 0.1 wt %, on the intermediate transfer body, and which transfers the transfer image to a recording medium, the inkjet recording apparatus comprising: a liquid application device which applies the second liquid on the intermediate transfer body and then ejects droplets of the first liquid toward the second liquid applied on the intermediate transfer body; and an electron beam irradiation device which radiates an electron beam on the first liquid and the second liquid on the intermediate transfer body, wherein: at least one of the first liquid and the second liquid contains a polymerizable compound which is polymerized when irradiated with the electron beam; and the electron beam irradiation device radiates the electron beam at an acceleration voltage of 40 kV through 60 kV.

In this aspect of the present invention, the above-described beneficial effects can be also obtained in the case where the transfer image is formed on the intermediate transfer body and is then transferred to the recording medium.

Preferably, a surface tension γA of the first liquid and a surface tension γB of the second liquid have a relationship of γA>γB.

In this aspect of the present invention, since there is the relationship of γA>γB, then it is possible to prevent the degradation of image quality more effectively.

Preferably, solvent contents in the first liquid and the second liquid are not greater than 1 wt %.

Here, the solvent indicates a liquid that contains no coloring material, no polymerizable compound and no diffusion inhibitor. Specific examples of the solvent includes a non-polymerizable liquid, such as water, an organic solvent, and the like.

In this aspect of the present invention, since there is hardly any content of the material (solvent) which is not involved in polymerization, then the cured state of the first liquid and the second liquid is even more satisfactory and the disturbance of the image can be suppressed yet further.

According to the present invention, it is possible to prevent the depositing interference between the ink droplets, as well as being able to prevent the degradation of image quality caused by curing defects, dot expansion, or movement of gravity center of dot.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 8 is a diagram showing evaluation results relating to practical example 1;

FIG. 9 is a diagram showing evaluation results relating to practical example 2.

DETAILED DESCRIPTION OF THE PREFERRED EMBODIMENTS

General Composition of Inkjet Recording Apparatus

Figure 1:
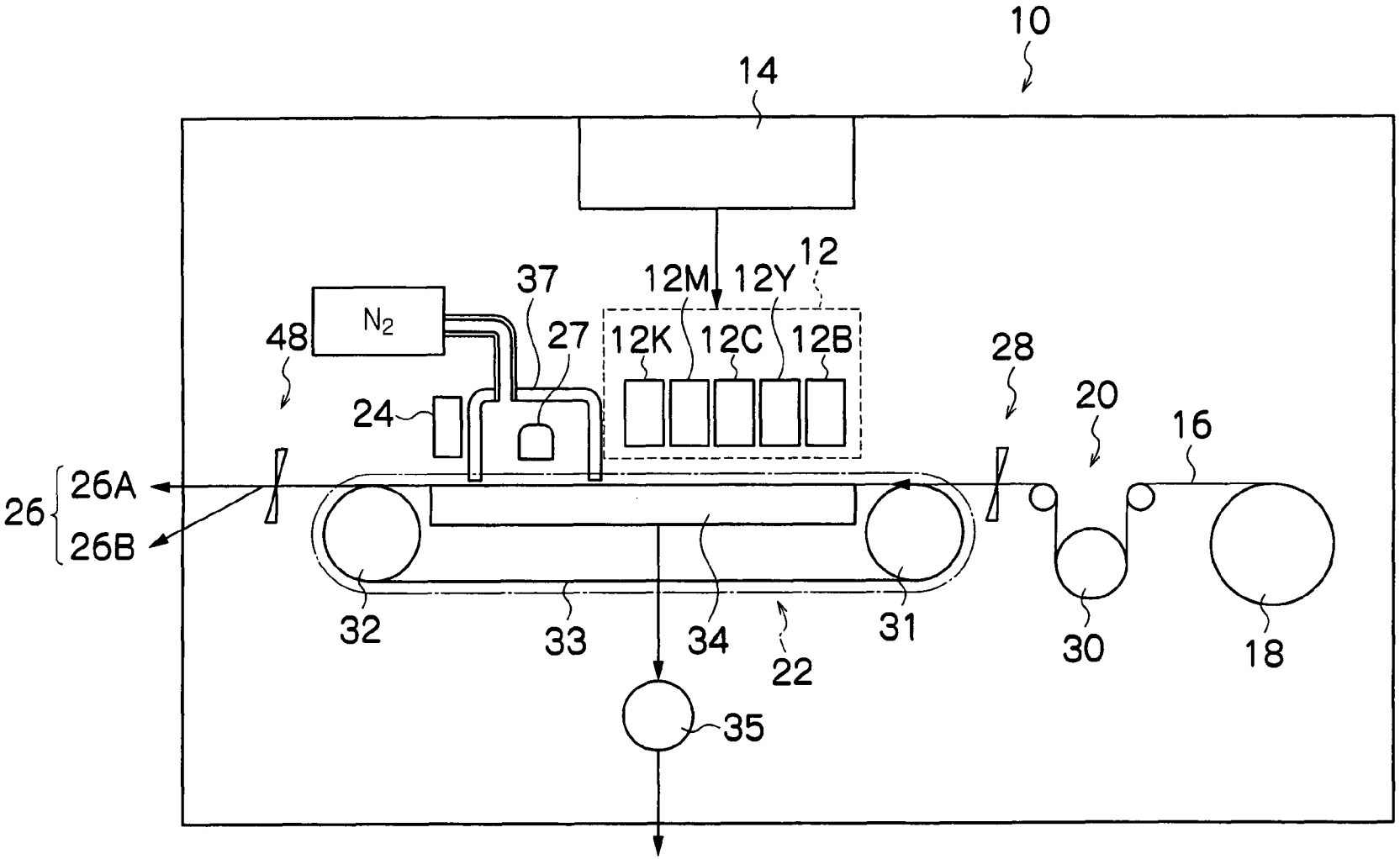
FIG. 1 is a general schematic drawing of an inkjet recording apparatus according to an embodiment of the present invention.

FIG. 1 shows the general composition of an inkjet recording apparatus 10 according to an embodiment of the present invention.

In FIG. 1, the inkjet recording apparatus 10 has a liquid application unit 12, which applies liquids A and a liquid B onto the recording medium 16 by means of droplet ejection. The liquids A contain coloring materials, and are hereinafter referred to as inks. The liquid B contains no coloring material, or contains coloring material of not more than 0.1 wt %, and is hereinafter referred to as a treatment liquid. The liquid application unit 12 first applies the liquid B (the treatment liquid) on the recording medium 16, and then applies the liquids A (the inks) on the recording medium 16, so that a desired image is formed on the recording medium 16. For purposes of convenience, descriptions are hereinafter made for cases where the liquid B (the treatment liquid) contains no coloring material.

The inkjet recording apparatus 10 further includes: a liquid storing and loading unit 14, which stores the liquids for supply to the liquid application unit 12; a paper supply unit 18, which supplies the recording medium 16, such as paper; a decurling unit 20, which removes curl from the recording medium 16; a belt conveyance unit 22, disposed facing the liquid ejection face of the liquid application unit 12, which conveys the recording medium 16 while keeping the recording medium 16 flat; an image determination unit 24, which reads in an image resulting from the ejection of the ink droplets by the liquid application unit 12 (namely, the deposition state of the ink droplets); and a paper output unit 26, which outputs the printed recording medium to the exterior.

In FIG. 1, a supply of rolled paper (continuous paper) is displayed as one example of the paper supply unit 18, but it is also possible to use a supply unit which supplies cut paper that has been cut previously into sheets. In a case where rolled paper is used, a cutter 28 is provided. The recording medium 16 delivered from the paper supply unit 18 generally retains curl. In order to remove this curl, heat is applied to the recording medium 16 in the decurling unit 20 by a heating drum 30 in the direction opposite to the direction of the curl. After decurling in the decurling unit 24, the cut recording medium 16 is delivered to the belt conveyance unit 22.

The suction belt conveyance unit 22 has a configuration in which an endless belt 33 is set around rollers 31 and 32 so that the portion of the endless belt 33 facing at least the liquid ejection face of the liquid application unit 12 and the sensor surface of the image determination unit 24 forms a horizontal plane (flat plane). The belt 33 has a width that is greater than the width of the recording medium 16, and a plurality of suction apertures (not shown) are formed on the belt surface. A suction chamber 34 is disposed in a position facing the liquid ejection face of the liquid application unit 12 and the sensor surface of the image determination unit 24 on the interior side of the belt 33, which is set around the rollers 31 and 32; and the suction chamber 34 provides suction with a fan 35 to generate a negative pressure, thereby holding the recording medium 16 onto the belt 33 by suction. The belt 33 is driven in the counter-clockwise direction in FIG. 1 by the motive force of a motor (not illustrated) being transmitted to at least one of the rollers 31 and 32, which the belt 33 is set around, and the recording medium 16 held on the belt 33 is conveyed from right to left in FIG. 1.

Figure 2:
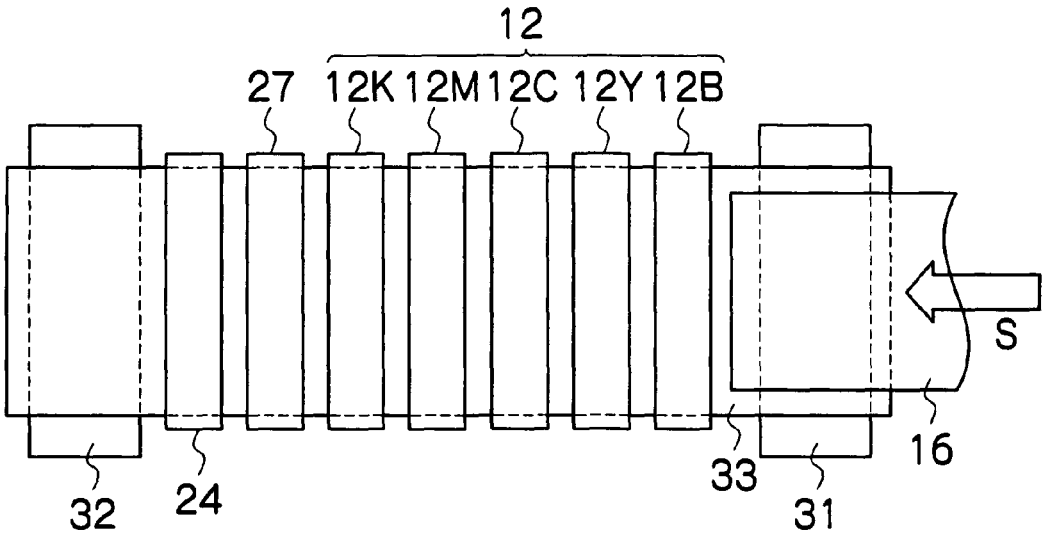
FIG. 2 is a plan diagram showing a liquid application unit in the inkjet recording apparatus and the peripheral region of same.

FIG. 2 shows a plan diagram of the liquid application unit 12 of the inkjet recording apparatus 10 and the peripheral region of same.

In FIG. 2, the liquid application unit 12 includes a droplet ejection head 12B for the treatment liquid, which ejects droplets of the treatment liquid (the liquid B) onto the recording medium 16 in a single pass, and droplet ejection heads 12Y, 12C, 12M and 12K for the inks, which eject droplets of the inks (the liquids A) onto the recording medium 16 in a single pass. More specifically, the liquid application unit 12 includes so-called full line heads, which are the line heads of a length corresponding to the full width of the recordable area of the recording medium 16 disposed in a direction (main scanning direction) that is perpendicular to the conveyance direction of the medium (the sub-scanning direction indicated by the arrow S in FIG. 2).

The droplet ejection heads 12B, 12Y, 12C, 12M and 12K of the present embodiment each have a plurality of nozzles (liquid ejection ports) arranged through a length exceeding at least one edge of the maximum-size recording medium 16 intended for use with the image recording apparatus 10.

Furthermore, the droplet ejection heads 12B, 12Y, 12C, 12M and 12K corresponding to the respective liquids are disposed in the sequence of: treatment liquid (B), yellow ink (Y), cyan ink (C), magenta ink (M) and black ink (K), from the upstream side (the right-hand side in FIG. 2), following the medium conveyance direction S, and hence a color image can be formed on the recording medium 16.

More specifically, firstly, the treatment liquid is deposited on the recording medium 16 by ejecting droplets of the treatment liquid onto the recording medium 16 from the treatment liquid ejection head 12B, and subsequently, droplets of the inks are ejected respectively from the ink ejection heads 12Y, 12M, 12C and 12K, onto the recording medium 16, in the region where the treatment liquid is present in the form of the liquid film. Here, since the ink droplets are submerged into the liquid film composed of the treatment liquid on the recording medium 16, then no new air-liquid interface is created and the depositing interference is avoided.

Furthermore, if using the liquid application unit 12 constituted by the full line droplet ejection heads, it is possible to record an image onto the whole surface of the recording medium 16, simply by performing one operation of moving the recording medium 16 and the liquid application unit 12 relatively to each other in the medium conveyance direction (sub-scanning direction). Higher-speed printing is thereby made possible and productivity can be improved in comparison with a shuttle type head configuration in which a droplet ejection head moves reciprocally in a direction (main scanning direction) which is perpendicular to the medium conveyance direction (sub-scanning direction).

The terms main scanning direction and sub-scanning direction are used in the following senses. More specifically, in a full-line head including rows of nozzles that have a length corresponding to the entire width of the recording medium, "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording medium relatively to each other. The direction in which sub-scanning is performed is called the sub-scanning direction. Consequently, the conveyance direction of the recording medium is the sub-scanning direction and the direction perpendicular to same is called the main scanning direction.

Although a configuration with the four colors, Y M C and K, is described in the present embodiment, the combinations of the ink colors and the number of colors are not limited to the examples described in the present embodiment, and light and/or dark inks, and background color inks, can be added as required. For example, a configuration is possible in which droplet ejection heads for ejecting light-colored inks such as light cyan and light magenta, or a head for ejecting white ink, are added.

An electron beam irradiation device 27 radiates an electron beam on the recording medium 16. In the present embodiment, a low-voltage electron beam irradiation device of vacuum tube type is used for the electron beam irradiation device 27. The electron beam irradiation device 27 is operated at an acceleration voltage of 40 kV through 60 kV and an irradiation dose of 30 kGy, for example. A chamber 37 which covers the electron beam irradiation device 27 and the recording medium 16 forming the irradiated object is provided, and electron beam irradiation is carried out in a state where the interior of the chamber 37 is filled with an inert gas such as nitrogen. It is also possible to use the chamber 37 as a shielding member for secondary radiation, such as X rays, which is produced when the electron beam is radiated.

Figure 10:
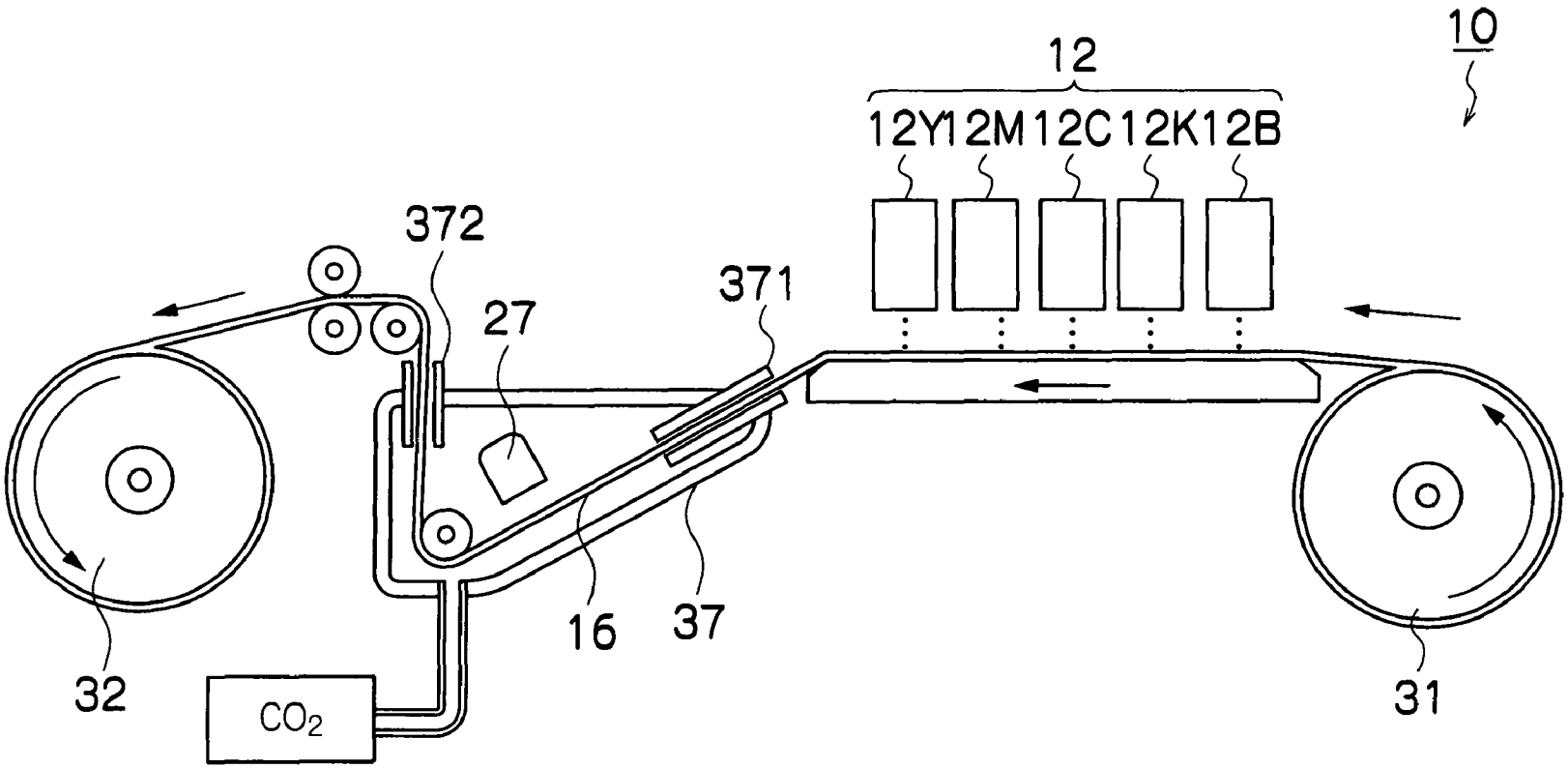
FIG. 10 is a principal schematic drawing showing the principal part of an image forming apparatus including an electron beam irradiation device according to another embodiment of the present invention.

A mode is also possible which uses an inert gas that has a specific gravity greater than the specific gravity of air, such as carbon dioxide gas. For example, a composition shown in FIG. 10 may be adopted in which a supply port 371 and an output port 372 through which the recording medium 16 is conveyed into and out of the chamber 37, are provided at positions above the irradiation position of the recording medium 16 opposite the electron beam irradiation device 27, and the chamber 37 is filled with an inert gas having a specific gravity greater than the specific gravity of air. By means of this composition, since there is a difference in specific gravity between the inert gas and the atmosphere, then the outflow of inert gas to the exterior of the chamber 37 is reduced to a minimum, thereby reducing the consumption of inert gas and making it possible to lower running costs. Moreover, at the same time, it is also possible to reduce unwanted outflow of gas to the exterior of the inkjet recording apparatus 10.

The electron beam is a flow of electrons that is accelerated and imparted with energy by means of a high voltage.

The liquid storing and loading unit 14 shown in FIG. 1 has a treatment liquid tank, which stores the treatment liquid, and ink tanks, which store the inks separately for the colors of Y, M, C and K, and the tanks are connected respectively to the droplet ejection heads 12B, 12Y, 12C, 12M and 12K, through tubing channels (not shown).

The image determination unit 24 has an image sensor (line sensor, or the like) for capturing an image of the droplet ejection result of the liquid application unit 12, and functions as a device to check for ejection abnormalities, such as blockages of the nozzles in the liquid application unit 12 on the basis of the image read in by the image sensor.

The recording medium 16 on which an image has been formed is output from the paper output unit 26. In the inkjet recording apparatus 10, a sorting device (not shown) is provided for switching the outputting pathway in order to sort the printed matter bearing the target print and the printed matter bearing the test print, and to send them to output units 26A and 26B, respectively. If the main image and the test print are formed simultaneously in a parallel fashion, on a large piece of printing paper, then the portion corresponding to the test print is cut off by means of the cutter (second cutter) 48. The cutter 48 is disposed immediately in front of the paper output section 26, and serves to cut and separate the main image from the test print section, in cases where a test image is printed onto the white margin of the image. Moreover, although omitted from the drawing, a sorter for collating and stacking the images according to job orders is provided in the paper output section 26A corresponding to the main images.

Structure of the Droplet Ejection Head

Figure 3A:
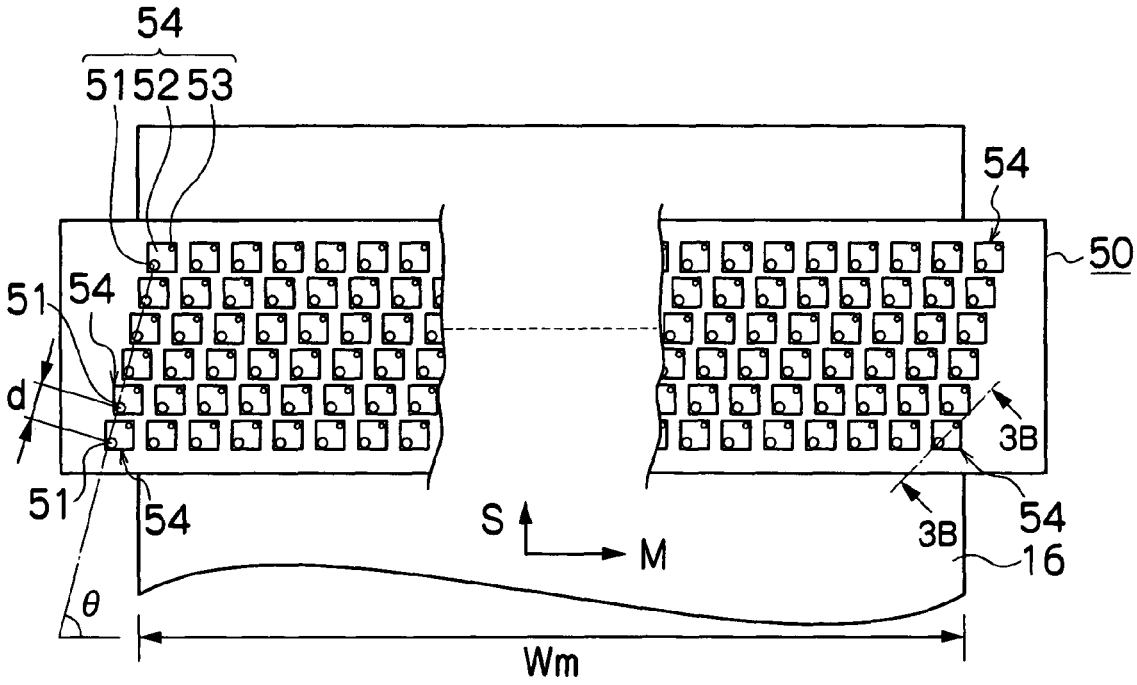
FIG. 3A is a plan view perspective diagram showing the overall structure of a droplet ejection head in the inkjet recording apparatus.

FIG. 3A is a plan view perspective diagram showing one of the droplet ejection heads in the inkjet recording apparatus 10, where the droplet ejection head is taken as a representative example of the droplet ejection heads 12B, 12Y, 12C, 12M and 12K shown in FIG. 2 and is denoted with reference numeral 50.

The droplet ejection head 50 shown in FIG. 3A is a so-called full line head, having a structure in which a plurality of nozzles 51 (liquid ejection ports) which eject liquid toward the recording medium 16 are arranged in a two-dimensional configuration through a length corresponding to the width Wm of the recording medium 16 in the direction perpendicular to the direction of conveyance of the recording medium 16 (the sub-scanning direction indicated by arrow S in FIG. 3A), in other words, in the main scanning direction indicated by arrow M in FIG. 3A.

The droplet ejection head 50 includes a plurality of pressure chamber units 54, each having the nozzle 51, a pressure chamber 52 connected to the nozzle 51, and a liquid supply port 53. The pressure chamber units 54 are arranged in two directions, namely, the main scanning direction M and an oblique direction forming a prescribed acute angle θ (where $0° < \theta < 90°$) with respect to the main scanning direction M. In FIG. 3A, in order to simplify the drawing, only a portion of the pressure chamber units 54 are depicted in the drawing.

In specific terms, the nozzles 51 are arranged at a uniform pitch d in the direction forming the prescribed acute angle of θ with respect to the main scanning direction M, and hence the nozzle arrangement can be treated as equivalent to a configuration in which the nozzles are arranged at an interval of $d \times \cos\theta$ in a single straight line following the main scanning direction M.

Figure 3B:
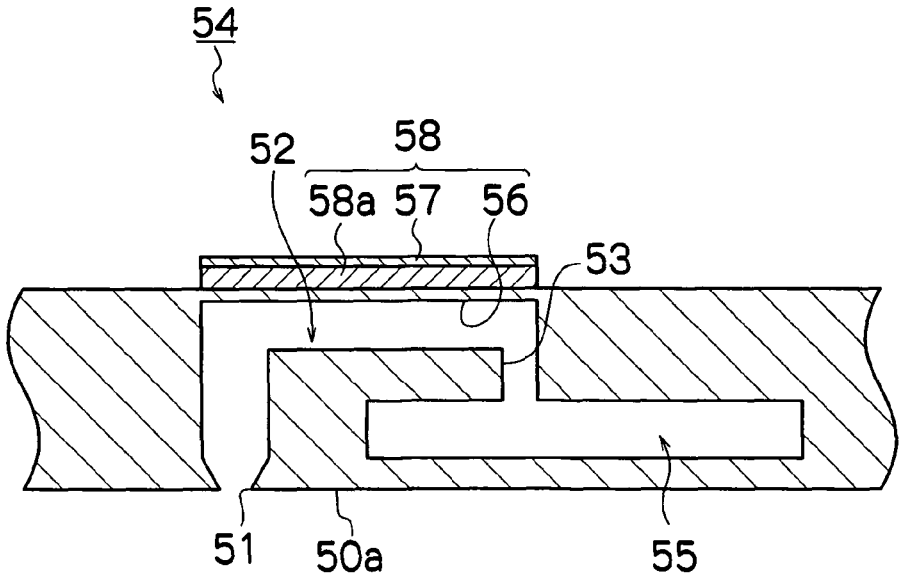
FIG. 3B is a cross-sectional diagram along line 3B-3B in FIG. 3A.

FIG. 3B shows a cross-sectional diagram along line 3B-3B in FIG. 3A of one of the aforementioned pressure chamber units 54, which forms one of the ejection elements constituting the droplet ejection head 50.

As shown in FIG. 3B, each pressure chamber 52 is connected to a common liquid chamber 55 through the liquid supply port 53. The common liquid chamber 55 is connected to a tank, which forms a liquid supply tank (not illustrated), and the liquid supplied from the tank is distributed and supplied to the respective pressure chambers 52 by means of the common liquid chamber 55.

A piezoelectric body 58*a* is disposed on top of a diaphragm 56, which constitutes the ceiling of the pressure chamber 52, and an individual electrode 57 is provided on top of this piezoelectric body 58*a*. The diaphragm 56 is earthed and also functions as a common electrode. A piezoelectric actuator 58, which forms a device for generating a liquid ejection force, is constituted by the diaphragm 56, the individual electrode 57 and the piezoelectric body 58*a*.

When a prescribed drive voltage is applied to the individual electrode 57 of the piezoelectric actuator 58, the piezoelectric body 58*a* deforms, thereby changing the volume of the pressure chamber 52, and this results in a change in the pressure inside the pressure chamber 52, which causes liquid to be ejected from the nozzle 51. When the volume of the pressure chamber 52 returns to normal after ejection of liquid, new liquid is supplied to the pressure chamber 52 from the common liquid chamber 55 via the liquid supply port 53.

FIG. 3A shows an example where the plurality of nozzles 51 are arranged two-dimensionally in order to achieve a structure whereby a high-resolution image can be formed at high-speed onto the recording medium 16, but the droplet ejection head according to the present invention is not limited in particular to the structure in which the plurality of nozzles 51 are arranged two-dimensionally, and it may also adopt a structure where a plurality of nozzles 51 are arranged one-dimensionally. Furthermore, the pressure chamber unit 54 shown in FIG. 3B is merely an example of the ejection element constituting a part of the droplet ejection head and the invention is not limited in particular to this case. For example, instead of disposing the common liquid chamber 55 below the pressure chambers 52 (in other words, between a liquid ejection face 50*a* and the pressure chambers 52), it is also possible to dispose the common liquid chamber 55 above the pressure chambers 52 (in other words, on the side of the pressure chambers 52 reverse to the side facing to the liquid ejection face 50*a*). Furthermore, it is also possible to generate a liquid ejection force by using heating bodies instead of piezoelectric bodies 58*a*, for example.

In the present invention, as the device for applying the treatment liquid onto the recording medium, it is possible to use another application device, rather than one based on ejecting the treatment liquid from the nozzles.

There are no particular restrictions on the application device, and it is possible to select a commonly known application device, according to the required objective. Possible examples of such a device include: an air doctor coater, a blade coater, a lot coater, a knife coater, a squeeze coater, an immersion coater, a reverse roll coater, a transfer roll coater, a gravure coater, a kiss roll coater, a cast coater, a spray coater, a curtain coater, and an extrusion coater.

Description of Liquid Supply System

Figure 4:
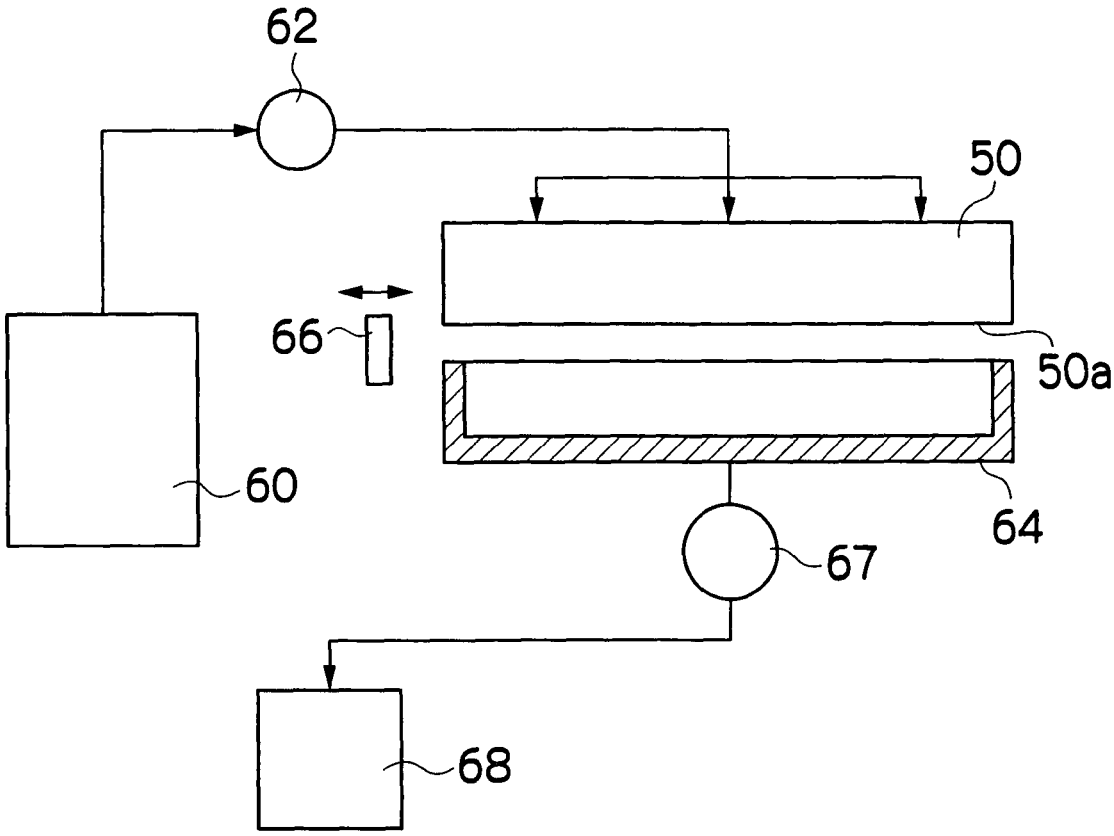
FIG. 4 is a principal compositional diagram showing a liquid supply system in the inkjet recording apparatus.

FIG. 4 is a conceptual diagram showing the composition of a liquid supply system in the inkjet recording apparatus 10.

The liquid tank 60 is a base tank for supplying the liquid to the droplet ejection head 50. A supply pump 62, which sends the liquid from the liquid tank 60 to the droplet ejection head 50, is provided at an intermediate point of the tubing channel that connects the liquid tank 60 with the droplet ejection head 50.

Furthermore, the inkjet recording apparatus 10 includes: a cap 64 forming a device for preventing drying of the liquid surfaces in the nozzles 51 or preventing increase in the ink viscosity in the vicinity of the liquid surfaces in the nozzles 51 during a prolonged idle period without ejection; and a cleaning blade 66 forming a device for cleaning the liquid ejection face 50*a*.

A maintenance unit including the cap 64 and the cleaning blade 66 can be moved in a relative fashion with respect to the droplet ejection head 50 by a movement mechanism (not shown), and is moved from a predetermined holding position to a maintenance position below the droplet ejection head 50, as and when required.

Furthermore, the cap 64 is raised and lowered in a relative fashion with respect to the droplet ejection head 50 by an elevator mechanism (not shown). The elevator mechanism raises the cap 64 to a predetermined elevated position so as to come into close contact with the droplet ejection head 50, and at least the nozzle region of the nozzle surface 50*a* is thus covered with the cap 64.

Moreover, desirably, the inside of the cap 64 is divided by means of partitions into a plurality of areas corresponding to the nozzle rows, thereby achieving a composition in which suction can be performed selectively in each of the demarcated areas, by means of a selector, or the like.

The cleaning blade 66 is composed of rubber or another elastic member, and can slide on the liquid ejection face 50*a* of the droplet ejection head 50 by means of a cleaning blade movement mechanism (not shown). If droplets or foreign matter have become attached to the liquid ejection face 50*a*, then the liquid ejection face 50*a* is wiped by sliding the cleaning blade 66 over the liquid ejection face 50*a*, in such a manner that the liquid ejection face 50*a* is cleaned.

In a state where the liquid ejection face 50*a* of the droplet ejection head 50 is covered with the cap 64, a suction pump 67 suctions the liquid from the nozzles 51 of the droplet ejection head 50 and sends the suctioned liquid to a recovery tank 68.

A suction operation of this kind is carried out when the liquid is filled into the droplet ejection head 50 from the liquid tank 60 when the liquid tank 60 is installed in the inkjet recording apparatus 10 (initial filling), and it is also carried out when removing liquid of increased viscosity after the apparatus has been out of use for a long period of time (start of use after long period of inactivity).

Here, to categorize the types of ejection performed from the nozzles 51, there is, firstly, normal ejection performed onto the recording medium in order to form an image on the recording medium, such as paper, and secondly, purging (also called dummy ejection) performed onto the cap 64, using the cap 64 as an ink receptacle.

Furthermore, if air bubbles infiltrate inside the nozzles 51 and the pressure chambers 52 of the droplet ejection head 50, or if the increase in the viscosity of the ink inside the nozzles 51 exceeds a certain level, then it becomes impossible to eject the liquid from the nozzles 51 in the aforementioned dummy ejection operation, and therefore, the cap 64 is abutted against the liquid ejection face 50*a* of the droplet ejection head 50, and an operation is performed to suction out the liquid containing air bubbles or the liquid of increased viscosity inside the pressure chambers 52 of the droplet ejection head 50, by means of the suction pump 67.

For the member used for liquid supply and cleaning, a material is selected that is not corroded with the treatment liquid or the inks used, even if it makes contact with same.

Description of Control System

Figure 5:
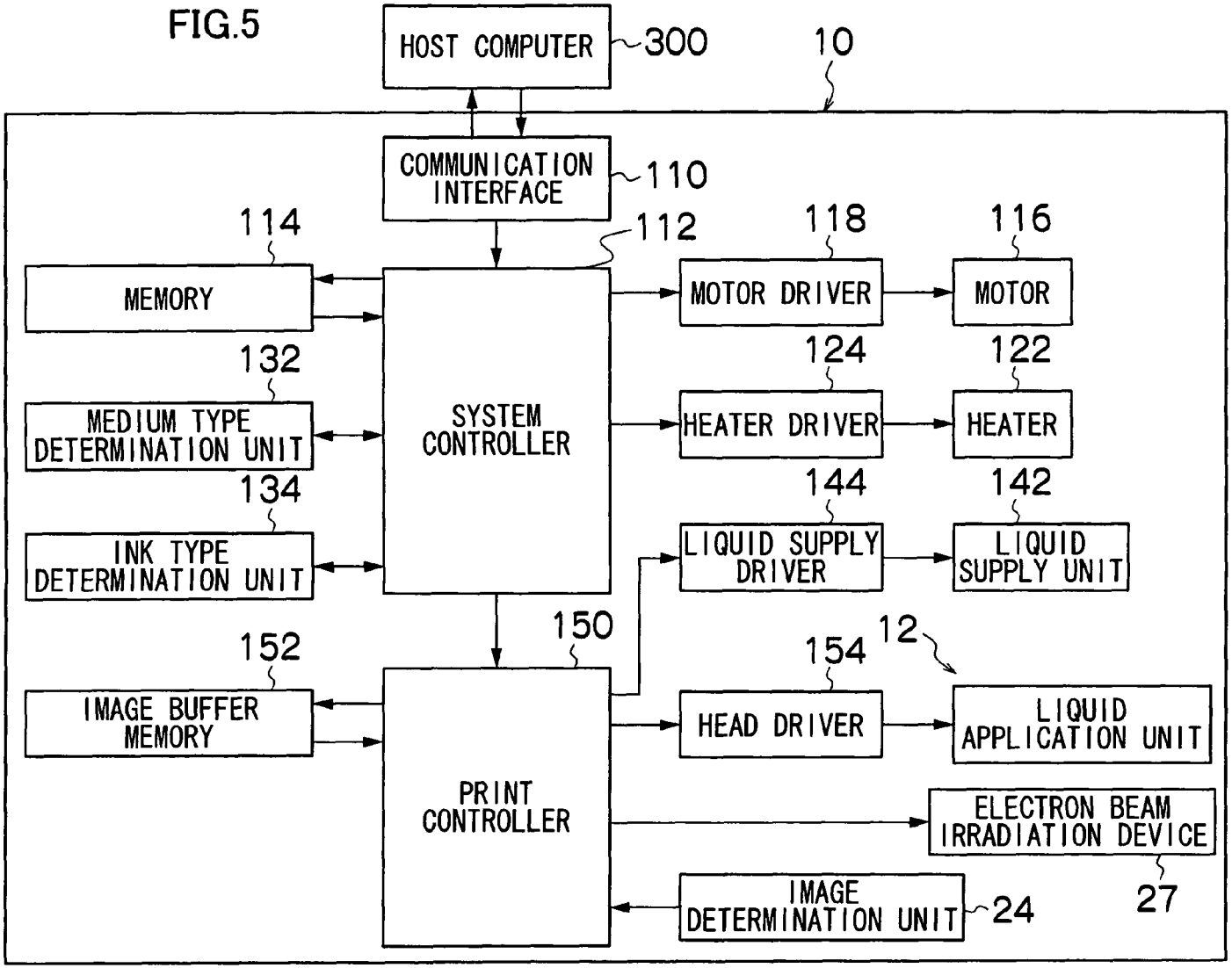
FIG. 5 is a system composition diagram used to describe a control system in the inkjet recording apparatus.

FIG. 5 is a principal block diagram showing the system composition of the inkjet recording apparatus 10.

In FIG. 5, the inkjet recording apparatus 10 includes: the liquid application unit 12, the image determination unit 24, the electron beam irradiation device 27, a communication interface 110, a system controller 112, memories 114 and 152, a conveyance motor 116, a motor driver 118, a heater 122, a heater driver 124, a medium type determination unit 132, an ink type determination unit 134, a liquid supply unit 142, a liquid supply driver 144, a print controller 150, and a head driver 154.

Since the liquid application unit 12, the image determination unit 24 and the electron beam irradiation device 27 are the same as those described in FIG. 1, and have been described already, then further description thereof is omitted here.

The communication interface 110 is an image data input device for receiving image data transmitted from a host computer 300. For the communication interface 110, a wired or wireless interface, such as a USB (Universal Serial Bus), IEEE 1394, or the like, can be used. The image data input to the inkjet recording apparatus 110 through the communication interface 110 is stored temporarily in the first memory 114 for storing image data.

The system controller 112 is constituted by a central processing unit (CPU) and peripheral circuits thereof, and the like, and it forms a main control device which controls the whole of the inkjet recording apparatus 10 in accordance with a prescribed program stored previously in the first memory 114. More specifically, the system controller 112 controls the respective units of the communication interface 110, the motor driver 118, the heater driver 124, the medium type determination unit 132, the ink type determination unit 134, the print controller 150, and the like.

The conveyance motor 116 supplies a motive force to the roller and belt, and the like, in order to convey the recording medium, such as the paper. The droplet ejection heads 50 constituting the liquid application unit 12, and the recording medium, are moved relatively to each other by means of the conveyance motor 116. The motor driver 118 is a circuit which drives the conveyance motor 116 in accordance with instructions from the system controller 112.

The heater driver 124 is a circuit which drives the heater 122 in the heating drum 30 in FIG. 1 and other heaters 122, in accordance with instructions from the system controller 112.

The medium type determination unit 132 determines the type of the recording medium. There are various possible modes for determining the recording medium. For example, there is a mode where the medium type is determined by providing a sensor in the paper supply unit 18 in FIG. 1, a mode where it is input by an operation performed by the user, a mode where it is input from the host computer 300, and a mode where it is determined automatically by analyzing the image data input from a host computer 300 (for example, the resolution and color) or the additional data of the image data.

The ink type determination unit 134 determines the type of the ink. There are various possible modes for determining the type of ink. For example, there is a mode where the ink type is determined by providing a sensor in the liquid storing and loading unit 14 in FIG. 1, a mode where it is input by an operation by the user, a mode where it is input from the host computer 300, and a mode where it is determined automatically by analyzing the image data input from the host computer 300 (for example, the resolution and color) or the additional data of the image data.

The liquid supply unit 142 is constituted by a tubing channel and a liquid supply pump 62, and the like, whereby the ink is caused to flow from the liquid tank 60 in FIG. 4 to the liquid application unit 12.

The liquid supply driver 144 is a circuit which drives the liquid supply pump 62, and the like, constituting the liquid supply unit 142, in such a manner that the liquid is supplied to the liquid application unit 12.

The print controller 150 generates data (droplet ejection data) required in order to perform ejection (deposition) onto the recording medium from the respective droplet ejection heads 50 which constitute the liquid application unit 12, on the basis of the image data input to the image recording apparatus 10. More specifically, the print controller 150 is a control unit which functions as an image processing device that carries out various image treatment processes, corrections, and the like, in accordance with the control implemented by the system controller 112, in order to generate droplet ejection data, from the image data stored in the first memory 114, and it supplies the droplet ejection data thus generated to the head driver 154.

Furthermore, the print controller 150 instructs to the electron beam irradiation device 27 a specified acceleration voltage at which the electron beam irradiation device 27 radiates the electron beam. When the electron beam irradiation device 27 is configured to change the acceleration voltage within a range of 10 kV to 150 kV, instructions are issued to the electron beam irradiation device 27 in such a manner that the acceleration voltage assumes a predetermined acceleration voltage in the range of 40 kV to 60 kV, for example. It is also possible to alter the acceleration voltage within the range of 40 kV to 60 kV on the basis of the image that is used for the determination of the droplet ejection state by the image determination unit 24. The method of instructing the acceleration voltage to the electron beam irradiation device 27 depends on the composition of the electron beam irradiation device 27.

Furthermore, the print controller 150 decides the thickness of the liquid film to be formed on the recording medium by the treatment liquid, on the basis of the medium type determined by the medium type determination unit 132 and the ink type determined by the ink type determination unit 134, and it adjusts the thickness of the liquid film by controlling the droplet ejection volume of the treatment liquid by means of the head driver 154.

An image buffer memory (also referred to as "second memory") 152 is appended to the print controller 150, and droplet ejection data, and the like, is stored temporarily in the second memory 152 during image processing by the print controller 150.

In FIG. 5, the second memory 152 is depicted as being appended to the print controller 150; however, it may also be combined with the first memory 114. Also possible is a mode in which the print controller 150 and the system controller 112 are integrated to form a single processor.

The head driver 154 outputs ejection drive signals to the respective droplet ejection heads 50 constituting the liquid application unit 12, on the basis of the droplet ejection data supplied from the print controller 150 (in practice, the droplet ejection data stored in the second memory 152). By supplying the ejection drive signals output from the head driver 154 to the respective droplet ejection heads 50 (more specifically, to the actuators 58 shown in FIG. 3B), the liquid (in the form of droplets) is ejected from the droplet ejection heads 50 toward the recording medium.

Next, an embodiment of the liquid application for forming an image on the recording medium 16 while avoiding the depositing interference is described with reference to FIGS. 6A to 6E.

Figure 6A:
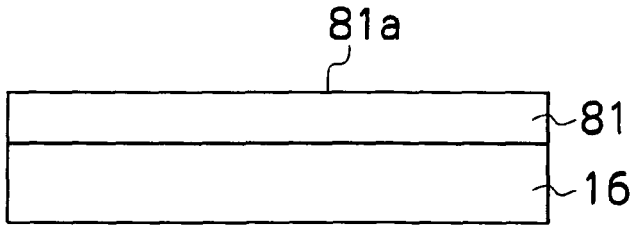
FIGS. 6A to 6E are schematic drawings used to describe the avoidance of depositing interference.

Firstly, as shown in FIG. 6A, the liquid B (the treatment liquid) that contains no coloring material or contains coloring material of not more than 0.1 wt % is applied on the recording medium 16, and a liquid film 81 composed of the liquid B is thus formed on the surface of the recording medium 16. In this case, the liquid B may be applied onto the recording medium 16 by ejection and deposition of droplets of the liquid B or by application with a roller, blade, etc. The method of depositing the droplets is preferable in that it is possible to form the liquid film composed of the liquid B readily, only in the region where the liquid B is required to be applied as the preparation for the deposition of the liquids A (the inks) containing coloring materials.

The liquid film 81 of the liquid B thus formed has an average thickness calculated by dividing the volume of the applied liquid B by the surface area of the portion on which the liquid B is applied. In cases where the liquid B is applied by the droplet deposition, the film thickness can be calculated in accordance with the volume of droplets of the liquid B ejected and the surface area of the portion on which the droplets of the liquid B are deposited. Desirably, the thickness of the film of the liquid B is uniform and there are no local variations in thickness. From this viewpoint, desirably, the liquid B has good wetting properties (in other words, a low surface tension), whereby it spreads readily over the recording medium 16, while the wetting properties fall within the range in which the liquid B can be ejected stably from the liquid ejection head 50 performing the droplet ejection.

Figure 6B:
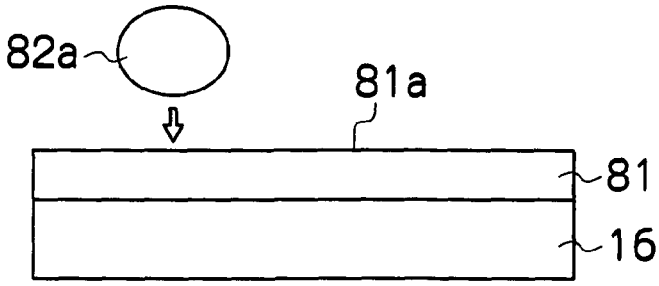
Figure 6C:
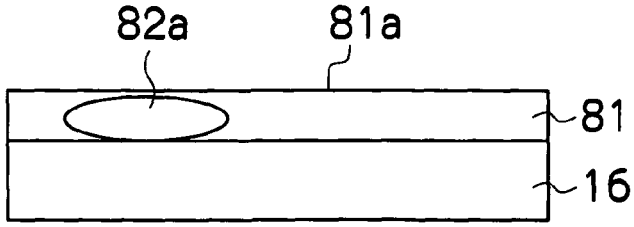

Thereupon, as shown in FIG. 6B, a droplet 82*a* (first ink droplet) of the liquid A (ink) containing coloring material is deposited toward the region where the liquid film 81 composed of the liquid B has been formed on the recording medium 16, in a state where the only air-liquid interface is the boundary surface 81*a* between the liquid B and the atmosphere, in other words, where there is substantially no change in the interfacial area of the air-liquid interface 81*a*. As a result of this droplet deposition, as shown in FIG. 6C, the first ink droplet 82*a* becomes submerged into the liquid film 81.

Figure 6D:
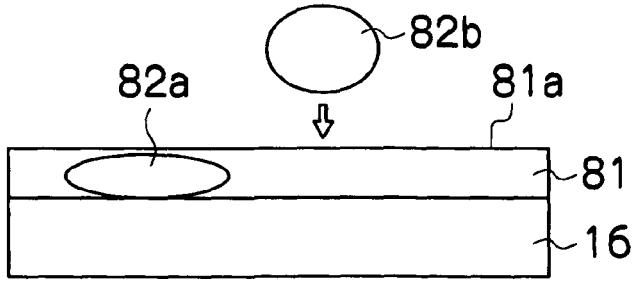
Figure 6E:
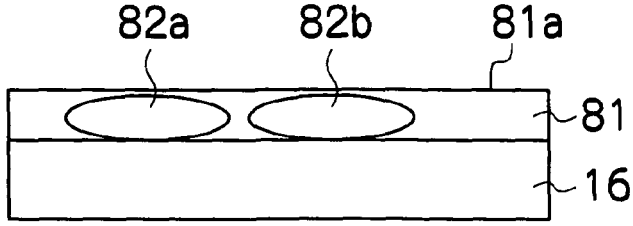

Then, as shown in FIG. 6D, a second ink droplet 82*b* is further deposited within the region where the liquid film 81 composed of the liquid B has been formed on the recording medium 16, in the vicinity of the depositing position of the first ink droplet 82*a* that has been deposited previously. As shown in FIG. 6E, the second ink droplet 82*b* also becomes submerged into the liquid film 81.

By submerging the plurality of ink droplets 82*a* and 82*b* inside the liquid film 81 composed of the liquid B, then even if the plurality of droplets 82*a* and 82*b* deposit in positions that are mutually adjacent, no new air-liquid interface is created. More specifically, the only boundary interface between the gas and the liquid is the boundary interface 81*a* between the atmosphere and the liquid film 81 composed of the liquid B, and therefore, the interfacial area of the air-liquid interface 81*a* does not change.

If a plurality of ink droplets 82*a* and 82*b* are deposited in a state where there is no liquid film 81 composed of the liquid B on the recording medium 16, then the depositing interference occurs due to the coalescence of the plurality of the ink droplets 82*a* and 82*b* as they seek to reduce the interfacial area of the air-liquid interface, in other words, to minimize the total energy. However, according to the present embodiment, the depositing interference of this kind can be avoided.

In order to apply the liquids on the recording medium 16 so as to prevent the above-described depositing interference, the surface tension $\gamma A$ of the liquid A (the ink) and the surface tension $\gamma B$ of the liquid B (the treatment liquid) have the relationship of $\gamma A > \gamma B$, preferably.

Furthermore, during a period of time (a time period from several hundred milliseconds to five seconds, in the present embodiment) in which the depositing interference is avoided and the shapes of the ink droplets 82*a* and 82*b* are being maintained inside the liquid film 81 as shown in FIG. 6E, in other words, before the dot shapes become disrupted, the ink droplets 82*a* and 82*b* are cured by the electron beam (EB) irradiation, and the coloring material inside the ink droplets 82*a* and 82*b* becomes fixed to the recording medium 16. At least one of the liquid A and the liquid B contains a polymerizable compound that is EB-curable and is cured by a so-called polymerization reaction when irradiated with the electron beam. It is also possible for both the liquid A and the liquid B to contain the polymerizable compound, and this is desirable since the whole of the liquid A and the liquid B deposited can be cured and hence fixing properties can be improved.

The embodiment is described with reference to FIGS. 6A to 6E in the case where the depositing interference is avoided while the liquid B does not contain a material that generates a chemical reaction that causes the coloring material to aggregate or become insoluble, but the present invention is not limited in particular to this. It is possible for the liquid B to have a function to cause the coloring material or the like in the liquid A (the ink) to aggregate, and the liquid B thereby assumes a high viscosity through the reaction with the liquid A, so that the depositing interference between the ink droplets can be avoided.

Figure 7:
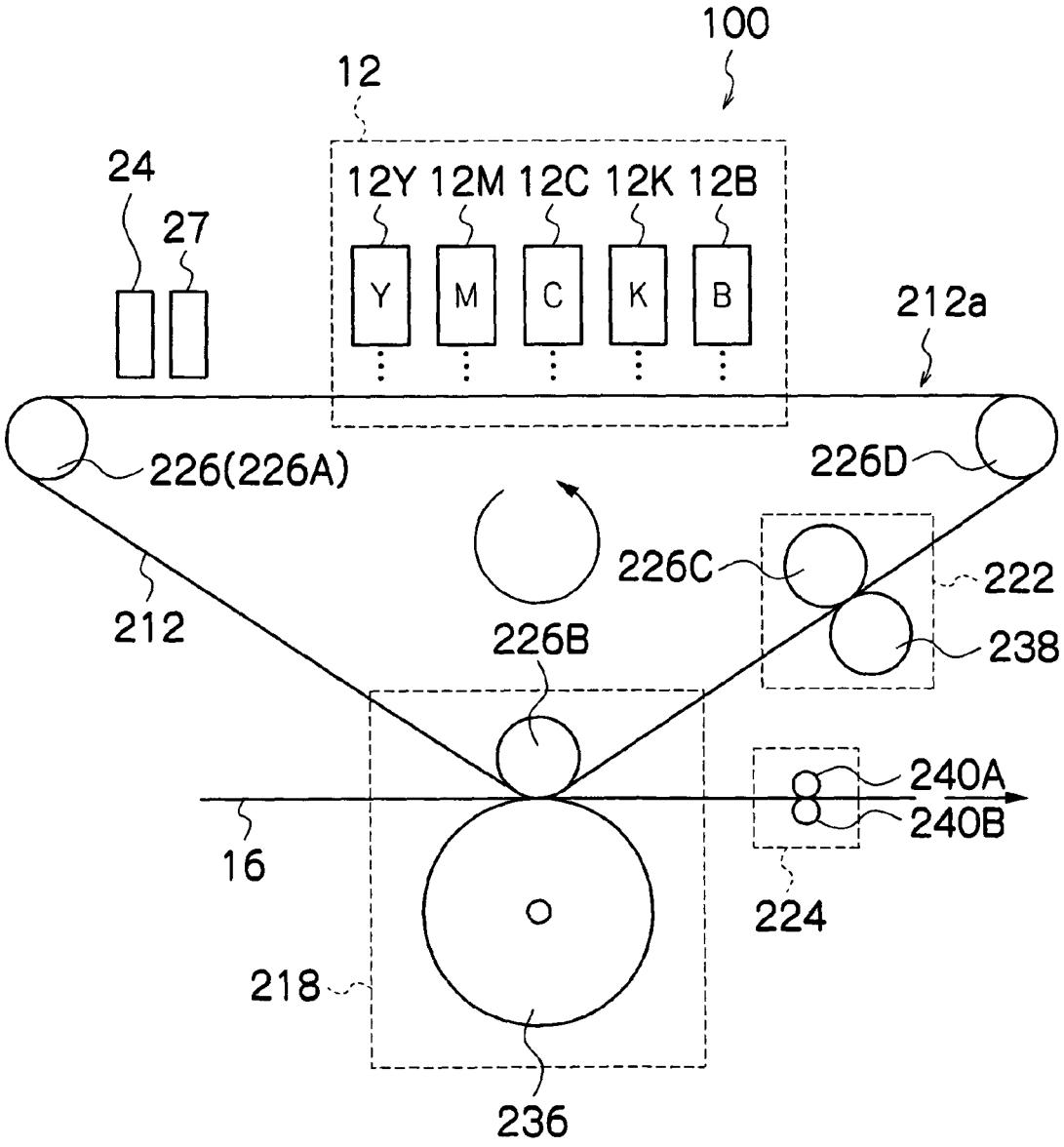
FIG. 7 is a general schematic drawing of an inkjet recording apparatus having an intermediate transfer body according to another embodiment of the present invention.

FIG. 7 is a schematic drawing of an inkjet recording apparatus 100 according to another embodiment of the present invention. As shown in FIG. 7, the inkjet recording apparatus 100 mainly includes: the liquid application unit 12, an intermediate transfer body 212, and a transfer unit 218; and also a cleaning unit 222 and an image fixing unit 224. The inkjet recording apparatus 100 may further include a solvent removal unit (not shown).

The intermediate transfer body 212 is constituted by an endless belt having a prescribed width, and it is wound about a plurality of rollers 226. In the present embodiment, for example, four rollers 226A to 226D are used. There are also modes which use a drum-shaped member and a plate-shaped member as the intermediate transfer body 212.

The driving force of a motor (not illustrated) is transmitted to at least one main roller of the plurality of rollers 226, and by driving this motor, the intermediate transfer body 212 is caused to rotate about the outer side of the rollers 226 (226A to 226D) in the counter-clockwise direction in FIG. 7 (hereinafter, referred to as the "direction of rotation of the intermediate transfer body").

The liquid application unit 12 is provided with the treatment liquid ejection head 12B, which ejects droplets of the treatment liquid toward the intermediate transfer body 212, and the ink ejection heads 12K, 12C, 12M and 12Y, which eject droplets of the inks of the colors of black (K), cyan (C), magenta (M) and yellow (Y) toward the intermediate transfer body 212.

The treatment liquid ejection head 12B and the ink ejection heads 12K, 12C, 12M and 12Y are all full line heads formed with a plurality of ejection ports (nozzles) through the maximum recordable width of an image formed on the intermediate transfer body 212. This makes it possible to record images at higher speed onto the intermediate transfer body 212, compared to a serial head which records by moving a short shuttle head back and forth reciprocally in the breadthways direction of the intermediate transfer body 212 (the direction of the obverse-reverse of the sheet containing FIG. 7). Of course, the present invention can also be applied suitably to a serial head system that is capable of relatively high-speed recording, for example, a one-pass recording system which forms one line by means of one scan.

In the present embodiment, all of the treatment liquid ejection head 12B and the ink ejection heads 12K, 12C, 12M and 12Y have the same structure described with reference to FIGS. 3A and 3B, for example. The implementation of the present invention is not limited to a case where the treatment liquid ejection head 12B and the ink ejection heads 12K, 12C, 12M and 12Y all have the same structure, and it is possible, for example, for the treatment liquid ejection head 12B and the ink ejection heads 12K, 12C, 12M and 12Y to have separate structures.

When the treatment liquid has been deposited from the treatment liquid ejection head 12B onto the intermediate transfer body 212, then due to the rotation of the intermediate transfer body 212, the region of the intermediate transfer body 212 on which the treatment liquid has been deposited is moved successively to positions directly below the ink ejection heads 12K, 12C, 12M and 12Y, and the corresponding inks of the respective colors are deposited from the ink ejection heads 12K, 12C, 12M and 12Y. The treatment liquid has a function of causing the solvent-insoluble material (coloring material, etc.) in the inks to aggregate. Therefore, the inks deposited on the intermediate transfer body 212 assume a high viscosity by reacting with the treatment liquid, thereby preventing the depositing interference between ink droplets of the same color or different colors, and hence forming an image of high quality on the intermediate transfer body 212.

The transfer unit 218 is disposed on the downstream side of the liquid application unit 12 in terms of the rotation direction of the intermediate transfer body 212. The transfer unit 218 includes a pressurization roller 236 at a position facing the roller 226B across the intermediate transfer body 212. The recording medium 16 is conveyed from the left-hand side to the right-hand side in FIG. 7, in such a manner that it passes between the intermediate transfer body 212 and the pressurization roller 236. When the recording medium 16 passes between the intermediate transfer body 212 and the pressurization roller 236, the front surface side of the recording medium 16 makes contact with the recording surface 212*a* of the intermediate transfer body 212, and pressure is applied by the pressurization roller 236, from the rear surface side of the recording medium 16, thereby causing the image formed on the recording surface 212*a* of the intermediate transfer body 212 to be transferred onto the recording medium 16. Here, it is preferable that the pressurization roller 236 and/or the roller 226B is heated in order to improve the transfer characteristics.

The cleaning unit 222 is disposed on the downstream side of the transfer unit 218 in terms of the direction of rotation of the transfer body 212, and on the upstream side of the liquid application unit 12 in terms of the direction of rotation of the transfer body 212. The cleaning unit 222 includes a cleaning roller 238, which is provided in a position facing the roller 226C across the intermediate transfer body 212 and is disposed so as to abut against the recording surface 212*a* of the intermediate transfer body 212, thereby removing the residual matter, and the like, which is left on the recording surface 212*a* of the intermediate transfer body 212 after the transfer.

The cleaning roller 238 may be made of a flexible and porous member, which cleans the surface of the intermediate transfer body 212 (recording surface 212*a*) while being impregnated with cleaning liquid from a cleaning liquid deposition device, or a brush may be provided on the surface of the cleaning roller 238 and dirt may be removed from the surface of the intermediate transfer body 212 with the brush, while depositing cleaning liquid onto the surface of the intermediate transfer body 212. Alternatively, residual material on the surface of the intermediate transfer body 212 may be wiped away by providing a flexible blade on the surface of the cleaning roller 238. Making the linear speed of the surface of the cleaning roller 238 slower or faster than the linear speed of the surface of the intermediate transfer body 212, rather than the same speed, enables the removal rate of the residual matter to be increased. This is because the speed differential between the surface of the cleaning roller 38 and the surface of the intermediate transfer body 212 generates a shearing force at the surface of the intermediate transfer body 212, and this causes the residual matter to be removed effectively.

The image fixing unit 224 is disposed on the recording medium output side of the transfer unit 218 (the right-hand side in FIG. 7). The image fixing unit 224 includes two fixing rollers 240A and 240B, arranged at the front and rear surfaces of the recording medium 16, and by heating and pressurizing the image having been transferred to the recording medium 16 by means of these fixing rollers 240A and 240B, it is possible to increase the fixing characteristics of the recording image on the recording medium 16.

In the inkjet recording apparatus 100 shown in FIG. 7, the liquids A (inks) containing coloring materials and the liquid B (treatment liquid) containing no coloring material or having a coloring material content equal to or less than 0.1 wt % are deposited on the intermediate transfer body 212 by means of the liquid deposition unit 12, thereby forming a transfer image on the intermediate transfer body 212, and this transfer image is then transferred to the recording medium 16 by means of the transfer unit 218. At least one of the liquid A (ink) and the liquid B (treatment liquid) contains a polymerizable compound. The liquid B (treatment liquid) is deposited onto the intermediate transfer body 212 by droplet ejection, whereupon the liquid A (ink) is deposited onto the intermediate transfer body 212 by droplet ejection. The electron beam irradiation device 27 which radiates an electron beam onto the intermediate transfer body 212 on which the liquid A (ink) and the liquid B (treatment liquid) have been deposited is provided on the downstream side of the liquid deposition unit 12 in terms of the direction of rotation of the transfer body, and it radiates an electron beam at an acceleration voltage of 40 kV to 60 kV onto the recording surface 212*a* of the intermediate transfer body 212.

Substances Contained in Liquid

The substances contained in the liquid applied on the recording medium by the liquid application unit 12 are described in detail below.

The inkjet recording apparatus 10 in the present embodiment uses a liquid containing one or more of substances selected from: a polymerizable compound (such as radiation-curable monomer and prepolymer including oligomer), a coloring material (also called a "coloring agent"), a dispersion inhibitor, and a high-boiling-point solvent (more specifically, an oil).

Polymerizable Compound

The polymerizable compound in the present invention has a curing function by generating a polymerization or bridging (cross-linking) reaction when irradiated with an electron beam.

The polymerizable compound used in the present invention is not limited to a particular compound, provided that the polymerizable compound is cured by producing a polymerization reaction due to irradiation with the electron beam, and it is possible to use any kind of monomer and prepolymer (e.g., oligomer). It is also possible to use one or more of polymerizable compounds for the purpose of adjusting the reaction speed, the ink properties and the properties of the cured film, and the like. Furthermore, the polymerizable compound may be a monofunctional compound or a polyfunctional compound.

Possible examples of the polymerizable compound are: a (meth)acrylate, a (meth)acrylamide, an aromatic vinyl, an epoxy compound, a vinyl ether compound, an oxetane compound, or the like. In the present specification, the term "(meth)acrylate" indicates "acrylate" and/or "methacrylate", and the term "(meth)acryl" indicates "acryl" and/or "methacryl".

Specific examples of a monofunctional (meth)acrylate include: a hexyl (meth)acrylate, 2-ethyl hexyl (meth)acrylate, tert-octyl (meth)acrylate, isoamyl (meth)acrylate, decyl (meth)acrylate, isodecyl (meth)acrylate, stearyl (meth)acrylate, isostearyl (meth)acrylate, cyclohexyl (meth)acrylate, 4-n-butyl cyclohexyl (meth)acrylate, bornyl (meth)acrylate, isobornyl (meth)acrylate, benzyl (meth)acrylate, 2-ethyhexyl diglycol (meth)acrylate, butoxyethyl (meth)acrylate, 2-chloroethyl (meth)acrylate, 4-bromobutyl (meth)acrylate, cyanoethyl (meth)acrylate, benzyl (meth)acrylate, butoxymethyl (meth)acrylate, 3-methoxybutyl (meth)acrylate, alkoxymethyl (meth)acrylate, alkoxyethyl (meth)acrylate, 2-(2-methoxyethoxy)ethyl (meth)acrylate, 2-(2-butoxyethoxy)ethyl (meth)acrylate, 2,2,2-tetrafluoroethyl (meth)acrylate, 1H,1H,2H,2H perfluorodecyl (meth)acrylate, 4-butyl phenyl (meth)acrylate, phenyl (meth)acrylate, 2,4,5-tetramethyl phenyl (meth)acrylate, 4-chlorophenyl (meth)acrylate, phenoxymethyl (meth)acrylate, phenoxyethyl (meth)acrylate, glycidyl (meth)acrylate, glycidyl oxybutyl (meth)acrylate, glycidyl oxyethyl (meth)acrylate, glycidyl oxypropyl (meth) acrylate, tetrahydrofurfuryl (meth)acrylate, hydroxyalkyl (meth)acrylate, 2-hydroxyethyl (meth)acrylate, 3-hydroxypropyl (meth)acrylate, 2-hydroxypropyl (meth)acrylate, 2-hydroxybutyl (meth)acrylate, 4-hydroxybutyl (meth)acrylate, 3-hydroxypropyl (meth)acrylate, dimethyl aminoethyl (meth)acrylate, diethyl aminoethyl (meth)acrylate, dimethyl aminopropyl (meth)acrylate, diethyl aminopropyl (meth) acrylate, trimethoxysilyl propyl (meth)acrylate, trimethylsilyl propyl (meth)acrylate, polyethylene oxide monomethyl ether (meth)acrylate, oligo-ethylene oxide monomethyl ether (meth)acrylate, polyethylene oxide (meth)acrylate, oligo-ethylene oxide (meth)acrylate, oligo-ethylene oxide monoalkyl ether (meth)acrylate, polyethylene oxide monoalkyl ether (meth)acrylate, dipropylene glycol (meth) acrylate, polypropylene oxide monoalkyl ether (meth)acrylate, oligo-propylene oxide monoalkyl ether (meth)acrylate, 2-methacryloyloxy ethyl succinate, 2-methacryloyloxy hexahydro phthalate, 2-methacryloyloxy ethyl 2-hydroxypropyl phthalate, butoxy diethylene glycol (meth)acrylate, trifluoroethyl (meth)acrylate, perfluoro octylethyl (meth) acrylate, 2-hydroxy-3-phenoxy propyl (meth)acrylate, EO-modified phenol (meth)acrylate, EO-modified cresol (meth) acrylate, EO-modified nonyl phenol (meth)acrylate, PO-modified nonyl phenol (meth)acrylate, EO-modified 2-ethyl hexyl (meth)acrylate, and the like.

Specific examples of a bi-functional (meth)acrylate include: 1,6-hexane diol di(meth)acrylate, 1,10-decane diol di(meth)acrylate, neopentyl glycol di(meth)acrylate, 2,4-dimethyl-1,5-pentane diol di(meth)acrylate, butyl ethyl propane diol (meth)acrylate, ethoxylated cyclohexane methanol di(meth)acrylate, polyethylene glycol di(meth)acrylate, oligo-ethylene glycol di(meth)acrylate, ethylene glycol di(meth)acrylate, 2-ethyl-2-butyl-butane diol di(meth)acrylate, hydroxy pivalic acid neopentyl glycol di(meth)acrylate, EO-modified bisphenol A di(meth)acrylate, bisphenol F polyethoxy di(meth)acrylate, polypropylene glycol di(meth) acrylate, oligo-propylene glycol di(meth)acrylate, 1,4-butane diol di(meth)acrylate, 2-ethyl-2-butyl propane diol di(meth) acrylate, 1,9-nonane di(meth)acrylate, propoxylated ethoxylated bisphenol A di(meth)acrylate, tricyclodecane di(meth) acrylate, and the like.

Specific examples of a tri-functional (meth)acrylate include: trimethylol propane tri(meth)acrylate, trimethylol ethane tri(meth)acrylate, an alkylene oxide-modified tri (meth)acrylate of trimethylol propane, pentaerythritol tri (meth)acrylate, dipentaerythritol tri(meth)acrylate, trimethylol propane tri((meth)acryloyloxy propyl)ether, isocyanuric acid alkylene oxide-modified tri(meth)acrylate, propionic acid dipentaerythritol tri(meth)acrylate, tri ((meth)acryloyloxy ethyl) isocyanurate, hydroxy pivalic aldehyde-modified dimethylol propane tri(meth)acrylate, sorbitol tri(meth)acrylate, propoxylated trimethylol propane tri(meth)acrylate, ethoxylated glycerin triacrylate, and the like.

Specific examples of a tetra-functional (meth)acrylate include: pentaerythritol tetra(meth)acrylate, sorbitol tetra (meth)acrylate, ditrimethylol propane tetra(meth)acrylate, propionic acid dipentaerythritol tetra(meth)acrylate, ethoxylated pentaerythritol tetra(meth)acrylate, and the like.

Specific examples of a penta-functional (meth)acrylate include: sorbitol penta(meth)acrylate or dipentaerythritol penta(meth)acrylate. Specific examples of a hexa-functional (meth)acrylate are: dipentaerythritol hexa(meth)acrylate, sorbitol hexa(meth)acrylate, an alkylene oxide-modified hexa(meth)acrylate of phosphazene, caprolactone-modified dipentaerythritol hexa(meth)acrylate, and the like.

Possible examples of a (meth)acrylamide usable in the present invention are: (meth)acrylamide, N-methyl (meth) acrylamide, N-ethyl (meth)acrylamide, N-propyl (meth) acrylamide, N-n-butyl (meth)acrylamide, N-t-butyl (meth) acrylamide, N-butoxy methyl (meth)acrylamide, N-isopropyl (meth)acrylamide, N-methylol (meth)acrylamide, N,N-dimethyl (meth)acrylamide, N,N-diethyl (meth) acrylamide, or (meth)acryloyl morphine.

Possible examples of aromatic vinyls usable in the present invention are: styrene, methyl styrene, dimethyl styrene, trimethyl styrene, ethyl styrene, isopropyl styrene, chloromethyl styrene, methoxy styrene, acetoxy styrene, chlorostyrene, dichlorostyrene, bromostyrene, methyl ester of vinyl benzoic acid, 3-methyl styrene, 4-methyl styrene, 3-ethyl styrene, 4-ethyl styrene, 3-propyl styrene, 4-propyl styrene, 3-butyl styrene, 4-butyl styrene, 3-hexyl styrene, 4-hexyl styrene, 3-octyl styrene, 4-octyl styrene, 3-(2-ethyl hexyl)styrene, 4-(2-ethyl hexyl)styrene, allyl styrene, isopropenyl styrene, butenyl styrene, octenyl styrene, 4-t-butoxycarbonyl styrene, 4-methoxystyrene, or 4-t-butoxystyrene.

Possible examples of the polymerizable monomers usable in the present invention include: vinyl esters (vinyl acetate, vinyl propionate, vinyl versatate, or the like), allyl esters (allyl acetate, or the like), a halogen-containing monomer (vinylidene chloride, vinyl chloride, or the like), a vinyl ether (methyl vinyl ether, butyl vinyl ether, hexyl vinyl ether, methoxy vinyl ether, 2-ethyl hexyl vinyl ether, methoxyethyl vinyl ether, cyclohexyl vinyl ether, chloroethyl vinyl ether, or the like), a vinyl cyamide ((meth)acrylonitrile, or the like), or an olefin (ethylene, propylene, or the like).

Of these, from the viewpoint of curing speed, it is desirable to use a (meth)acrylate or a (meth)acrylamide as the polymerizable monomer in the present invention, and it is particularly desirable from the viewpoint of curing speed to use a tetra-functional (meth)acrylate or higher-functional (meth)acrylate. Moreover, from the viewpoint of the viscosity of the composition of the liquid A (ink), it is desirable to combine the use of a polyfunctional (meth)acrylate, with a monofunctional or bi-functional (meth)acrylate or (meth)acrylamide.

Possible examples of the polymerizable compound usable in the present invention further include: an epoxy compound, a vinyl ether compound, an oxetane compound, or the like, as described in Japanese Patent Application Publication Nos. 6-9714, 2001-31892, 2001-40068, 2001-55507, 2001-310938, 2001-310937, 2001-220526, and the like.

Possible examples of the epoxy compound are: an aromatic epoxide, an alicyclic epoxide, and the like.

Specific examples of the monofunctional epoxy compound usable in the present invention include: phenyl glycidyl ether, p-tert-butyl phenyl glycidyl ether, butyl glycidyl ether, 2-ethyl hexyl glycidyl ether, allyl glycidyl ether, 1,2-butylene oxide, 1,3-butadiene monoxide, 1,2-epoxide decane, epichlorohydrin, 1,2-epoxydecane, styrene oxide, cyclohexane oxide, 3-methacryloyl oxymethyl cyclohexane oxide, 3-acryloyl oxymethyl cyclohexane oxide, 3-vinyl cyclohexene oxide, and the like.

Specific examples of the polyfunctional epoxy compound usable in the present invention include: bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, an epoxy novolak resin, hydrogenated bisphenol A diglycidyl ether, hydrogenated bisphenol F diglycidyl ether, hydrogenated bisphenol S diglycidyl ether, 3,4-epoxy cyclohexyl methyl-3',4'-epoxy cyclohexane carboxylate, 2-(3,4-epoxy cyclohexyl-5,5-spiro-3,4-epoxy) cyclohexane-meta-dioxane, bis(3,4-epoxy cyclohexyl methyl)adipate, vinyl cyclohexene oxide, 4-vinyl epoxy cyclohexane, bis(3,4-epoxy-6-methyl cyclohexyl methyl)adipate, 3,4-epoxy-6-methyl cyclohexyl-3',4'-epoxy-6'-methyl cyclo-hexane carboxylate, methylene-bis(3,4-epoxy cyclohexane), dicyclopentadiene diepoxide, a di(3,4-epoxy cyclohexyl methyl)ether of ethylene glycol, ethylene bis(3,4-epoxy cyclohexane carboxylate), dioctyl epoxy hexahydrophthalate, di-2-ethylhexyl epoxy hexahydrophthalate, 1,4-butane diol diglycidyl ether, 1,6-hexane diol diglycidyl ether, glycerine triglycidyl ether, trimethylol propane triglycidyl ether, polyethylene glycol diglycidyl ether, a polypropylene glycol diglycidyl ether, 1,1,3-tetradecadiene dioxide, limonene dioxide, 1,2,7,8-diepoxy octane, 1,2,5,6-diepoxy cyclooctane, 1-methyl-4-(2-methyl oxiranyl)-7-oxabicyclo [4.1.0]heptane, or the like.

Of these epoxy compounds, aromatic epoxides and alicyclic epoxides are desirable in view of their excellent curing speeds, and alicyclic epoxides are particularly desirable.

Specific examples of the monofunctional vinyl ether usable in the present invention include: methyl vinyl ether, ethyl vinyl ether, propyl vinyl ether, n-butyl vinyl ether, t-butyl vinyl ether, 2-ethyl hexyl vinyl ether, n-nonyl vinyl ether, lauryl vinyl ether, cyclohexyl vinyl ether, cyclohexyl methyl vinyl ether, 4-methyl cyclohexyl methyl vinyl ether, benzyl vinyl ether, dicyclopentenyl vinyl ether, 2-dicyclopentenoxy ethyl vinyl ether, methoxyethyl vinyl ether, ethoxyethyl vinyl ether, butoxyethyl vinyl ether, methoxyethoxy ethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethyl cyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, phenoxypolyethylene glycol vinyl ether, and the like.

Specific examples of the polyfunctional vinyl ether usable in the present invention include: divinyl ethers, such as ethylene glycol vinyl ether, diethylene glycol vinyl ether, polyethylene glycol divinyl ether, propylene glycol divinyl ether, butylene glycol divinyl ether, hexane diol divinyl ether, bisphenol A alkylene oxide divinyl ether, bisphenol F alkylene oxide divinyl ether, or the like; or trimethylol ethane trivinyl ether, trimethylol propane trivinyl ether, ditrimethylol propane tetravinyl ether, glycerine trivinyl ether, pentaerythritol tetravinyl ether, dipentaerythritol pentavinyl ether, dipentaerythritol hexavinyl ether, an ethylene oxide adduct of trimethylol propane trivinyl ether, a propylene oxide adduct of trimethylol propane trivinyl ether, an ethylene oxide adduct of ditrimethylol propane tetravinyl ether, a propylene oxide adduct of ditrimethylol propane tetravinyl ether, an ethylene oxide adduct of pentaerythritol tetravinyl ether, a propylene oxide adduct of pentaerythritol tetravinyl ether, an ethylene oxide adduct of dipentaerythritol hexavinyl ether, a propylene oxide adduct of dipentaerythritol hexavinyl ether, or the like.

From the viewpoint of curability, adhesion to the recording medium, and the surface hardness of the formed image, the vinyl ether compound is desirably a di-vinyl ether compound or tri-vinyl ether compound, and a di-vinyl ether compound is especially desirable.

The oxetane compound usable in the present invention includes a compound containing an oxetane ring, and a commonly known oxetane compound, such as those described in Japanese Patent Application Publication Nos. 2001-220526, 2001-310937, 2003-341217, and the like, may be used.

Desirably, the compound having an oxetane ring which is contained in the ink composition used for carrying out the present invention is a compound having 1 to 4 oxetane rings in its structure. By using a compound of this kind, the viscosity of the ink composition can be maintained easily within a range that is suitable for handling, as well as obtaining good adhesiveness of the ink to the recording medium after curing.

Specific examples of a monofunctional oxetane compound usable in the present invention include: 3-ethyl-3-hydroxymethyl oxetane, 3-(meta)allyloxymethyl-3-ethyloxetane, (3-ethyl-3-oxetanyl methoxy)methyl benzene, 4-fluoro-[1-(3-ethyl-3-oxetanyl methoxy)methyl]benzene, 4-methoxy-[1-(3-ethyl-3-oxetanyl methoxy)methyl]benzene, [1-(3-ethyl-3-oxetanyl methoxy)ethyl]phenyl ether, isobutoxymethyl (3-ethyl-3-oxetanyl methyl)ether, isobornyl oxyethyl (3-ethyl-3-oxetanyl methyl)ether, isobornyl (3-ethyl-3-oxetanyl methyl)ether, 2-ethyl hexyl (3-ethyl-3-oxetanyl methyl)ether, ethyl diethylene glycol (3-ethyl-3-oxetanyl methyl)ether, dicyclopentadiene (3-ethyl-3-oxetanyl methyl)ether, dicyclopentenyl oxyethyl (3-ethyl-3-oxetanyl methyl)ether, dicyclopentenyl (3-ethyl-3-oxetanyl methyl) ether, tetrahydrofurfuryl (3-ethyl-3-oxetanyl methyl)ether, tetrabromophenyl (3-ethyl-3-oxetanyl methyl)ether, 2-tetrabromophenoxyethyl (3-ethyl-3-oxetanyl methyl)ether, tribromophenyl (3-ethyl-3-oxetanyl methyl)ether, 2-tribromophenoxyethyl (3-ethyl-3-oxetanyl methyl)ether, 2-hydroxyethyl (3-ethyl-3-oxetanyl methyl)ether, 2-hydroxypropyl (3-ethyl-3-oxetanyl methyl)ether, butoxyethyl (3-ethyl-3-oxetanyl methyl)ether, pentachlorophenyl (3-ethyl-3-oxetanyl methyl)ether, pentabromophenyl (3-ethyl-3-oxetanyl methyl)ether, bornyl (3-ethyl-3-oxetanyl methyl)ether, or the like.

Specific examples of a polyfunctional oxetane usable in the present invention include: 3,7-bis(3-oxetanyl)-5-oxa-nonane, 3,3'-(1,3-(2-methylenyl)propane diylbis(oxymethylene)) bis-(3-ethyl oxetane), 1,4-bis[(3-ethyl-3-oxetanyl methoxy)methyl]benzene, 1,2-bis[(3-ethyl-3-oxetanyl methoxy)methyl]ethane, 1,3-bis[(3-ethyl-3-oxetanyl methoxy) methyl]propane, bis{[1-ethyl (3-oxetanil)]methyl}ether, ethylene glycol bis(3-ethyl-3-oxetanyl methyl)ether, dicyclopentenyl bis(3-ethyl-3-oxetanyl methyl)ether, triethylene glycol bis(3-ethyl-3-oxetanyl methyl)ether, tetraethylene glycol bis(3-ethyl-3-oxetanyl methyl)ether, tricyclodecane diyl dimethylene (3-ethyl-3-oxetanyl methyl)ether, trimethylol propane tris(3-ethyl-3-oxetanyl methyl)ether, 1,4-bis[(3-ethyl-3-oxetanyl methoxy)]butane, 1,6-bis(3-ethyl-3-oxetanyl methoxy)hexane, pentaerythritol tris(3-ethyl-3-oxetanyl methyl)ether, pentaerythritol tetrakis(3-ethyl-3-oxetanyl methyl)ether, polyethylene glycol bis(3-ethyl-3-oxetanyl methyl)ether, dipentaerythritol hexakis(3-ethyl-3-oxetanyl methyl)ether, dipentaerythritol pentakis(3-ethyl-3-oxetanyl methyl)ether, dipentaerythritol tetrakis(3-ethyl-3-oxetanyl methyl)ether, caprolactone-modified dipentaerythritol hexakis(3-ethyl-3-oxetanyl methyl)ether, caprolactone-modified dipentaerythritol pentakis(3-ethyl-3-oxetanyl methyl)ether, ditrimethylol propane tetrakis(3-ethyl-3-oxetanyl methyl)ether, EO-modified bisphenol A bis(3-ethyl-3-oxetanyl methyl)ether, PO-modified bisphenol A bis(3-ethyl-3-oxetanyl methyl)ether, EO-modified hydrogenated bisphenol A bis(3-ethyl-3-oxetanyl methyl)ether, PO-modified hydrogenated bisphenol A bis(3-ethyl-3-oxetanyl methyl)ether, EO-modified bisphenol F (3-ethyl-3-oxetanyl methyl)ether, and the like.

For the compound having oxetane rings of this kind, it is suitable to use the compounds described in detail in paragraphs (0021) to (0084) of Japanese Patent Application Publication No. 2003-341217.

Of the oxetane compounds usable in the present invention, it is desirable to use a compound having one to two oxetane rings from the viewpoint of the viscosity and the adhesiveness of the ink composition.

In the ink composition used for carrying out the present invention, it is possible to use only one type of these polymerizable compounds or two or more types of these polymerizable compounds. From the viewpoint of effectively suppressing contraction in curing of the ink, it is desirable to combine the use of at least one type of oxetane compound, and at least one type of compound selected from epoxy compounds and vinyl ether compounds.

It is possible either to use one type of polymerizable material only, or to use two or more types of polymerizable material.

The content of the polymerizable material in the treatment liquid, or if necessary in the inks, is desirably in the range of 50 wt % to 99.6 wt % with respect to the total solid content (weight) of the respective droplets, and more desirably, it is in the range of 70 wt % to 99.0 wt % and even more desirably, in the range of 80 wt % to 99.0 wt %, with respect to same.

Furthermore, desirably, the content of the polymerizable material in the droplets falls within the range of 20 wt % to 98 wt %, more desirably, the range of 40 wt % to 95 wt %, and especially desirably, the range of 50 wt % to 90 wt %, with respect to the total weight of the droplets.

Coloring Material

The coloring material may be a pigment or a dye, for example.

There are no particular restrictions on the coloring material used in the present invention, and provided that a color hue and color density that matches the object of use of the ink can be achieved, it is possible to select a coloring material appropriately from commonly known aqueous dyes, oil-based dyes and pigments. It is desirable that the liquid forming the inkjet recording ink is a non-aqueous liquid which does not contain an aqueous solvent, from the viewpoint of the stability of ink droplet ejection and rapid drying properties. Hence, it is desirable to use an oil-based dye or pigment which can readily be dispersed and dissolved uniformly in a non-aqueous liquid solution.

There are no particular restrictions on the oil-based dyes which are usable in the present invention, and any desired oil-based dye may be used. Desirably, in a case where an oil-based dye is used as the coloring material, the content ratio (converted to solid) of the dye falls within the range of 0.05 wt % to 20 wt %, more desirably, 0.1 wt % to 15 wt %, and even more desirably, 0.2 wt % to 6 wt %.

A mode which uses a pigment as the coloring material is desirable from the viewpoint of readily enabling the aggregation when mixing a plurality of types of liquids.

For the pigment used in the present invention, it is possible to use either an organic pigment or an inorganic pigment, and as regards a black pigment, a carbon black pigment, or the like, is desirable. Furthermore, in general, pigments of black, and three primary colors of cyan, magenta and yellow, are used, but depending on the required objective, it is also possible to use pigments having color hues, such as red, green, blue, brown, white, or the like, or a metallic lustrous pigment, such as gold or silver, or a colorless or light colored body pigment, or the like.

Moreover, for a pigment, it is also possible to use particles having a core material constituted by a particle of silica, alumina, or resin, with dye or pigment affixed to the surface thereof, or an insoluble lake compound of a dye, a colored emulsion, a colored latex, or the like.

Furthermore, it is also possible to use a pigment that has been coated with a resin. These are called micro-capsule pigments, and can be acquired as commercial products, from Dai-Nippon Ink Chemical Co., Ltd., Toyo Ink Co., Ltd., and the like.

From the viewpoint of achieving a balance between optical density and stability during storage, desirably, the volume-average particle size of the pigment particles contained in the liquid used for carrying out the present invention is in the range of 30 nm to 250 nm, and more desirably, 50 nm to 200 nm. Here, the volume-average particle size of the pigment particles can be measured by a measurement apparatus, such as an LB-500 manufactured by HORIBA Co., Ltd.

From the viewpoint of optical density and ejection stability, the content ratio (converted to a solid) when using a pigment as a coloring material is desirably in the range of 0.1 wt % to 20 wt % in the liquid, and more desirably, in the range of 1 wt % to 10 wt %.

It is possible to use only one type of coloring material and it is also possible to combine two or more types of coloring material. Furthermore, it is possible to use different coloring materials or the same coloring material, for each liquid.

Diffusion Inhibitor

In the present specification, "diffusion inhibitor" indicates a substance which prevents diffusion or bleeding of the liquid containing coloring material after its deposition on the recording medium.

For the diffusion inhibitor, at least one agent including a polymer having an amino group, a polymer having an onium group, a polymer having a nitrogen-containing hetero ring, and a metal compound, is used.

It is possible to use only one type of polymer, and the like, or it is possible to combine a plurality of types of polymers. Here, the term "a plurality of types" includes, for example, a case of polymers which belong to the category of polymers having an amino group, but which have different structures, or a case of polymers belonging to different types, such as a polymer having an amino group and a polymer having an onium group. Furthermore, it is also possible to make an amino group, an onium group, a nitrogen-containing heterocycle, and a metal compound coexist within the same molecule.

High-Boiling-Point Organic Solvent (Oil)

In the present specification, a high-boiling-point organic solvent means an organic solvent having a viscosity at 25° C. of 100 mPa·s or below or a viscosity at 60° C. of 30 mPa·s or below, and a boiling point above 100° C.

Here, the "viscosity" in the present specification is the viscosity measured by using a RE80 type viscometer manufactured by Toki Sangyo Co., Ltd. The RE80 viscometer is based on the conical rotor/flat plate measurement system equivalent to the E type, and measurement is carried out using the Code No. 1 rotor, at a rotational speed of 10 rpm. In the case of material having a viscosity greater than 60 mPa·s, according to requirements, measurement is carried out by changing the rotational speed to 5 rpm, 2.5 rpm, 1 rpm, 0.5 rpm, and the like.

In the present specification, the "water solubility" is the saturation concentration of water in the high-boiling-point organic solvent at 25° C., and it indicates the mass (gram) of water that can be dissolved per 100 g of the high-boiling-point organic solvent at 25° C.

Desirably, the amount of the high-boiling-point organic solvent used is 5 wt % to 2000 wt %, and more desirably, 10 wt % to 1000 wt % with respect to the coloring material used, when converted to applied amounts.

Electron Beam

In the present invention, an electron beam is used for the radiation to promote the polymerization of the polymerizable compound. When curing is performed by means of an electron beam, no polymerization initiator is required.

EXAMPLES

There follows a detailed description of practical examples 1 and 2.

Practical Example 1

Experiments were carried out under conditions shown in FIG. 8, in order to determine the appropriate acceleration voltage for the electron beam in a case where two liquids, namely, liquid A (ink) and liquid B (treatment liquid), are deposited onto a recording medium and an electron beam is used as curing radiation.

In FIG. 8, comparative examples under conditions 1 to 9, 13 and 14 are listed. In conditions 1 and 2, ultraviolet (UV) light was used as a curing radiation. In conditions 3 to 8, treatment liquid was not deposited on the recording medium and only ink was deposited. In conditions 9, 13 and 14, two liquids, namely, treatment liquid and ink, were deposited and an electron beam (EB) was used as a curing radiation, but the acceleration voltage of the electron beam was out of the preferable range (40 kV to 60 kV).

In contrast to these comparative examples (conditions 1 to 9, 13 and 14), conditions 10 to 12 are practical examples of the present invention. In conditions 10 to 12, two liquids, namely, treatment liquid and ink, were deposited, an electron beam (EB) was used as a curing radiation, and the acceleration voltage of the electron beam was within the preferable range (40 kV to 60 kV).

In practical example 1, liquid A1 was prepared as the ink, and liquid B1 was prepared as the treatment liquid. The liquid compositions of the liquids A1 and B1 are as follows.

Liquid A1:
bifunctional monomer (HDDA): 92 wt %,
hexafunctional monomer (DPCA60): 5 wt %,
pigment: 3 wt %

Liquid B1:
bifunctional monomer (HDDA): 92 wt %,
hexafunctional monomer (DPCA60): 3 wt %,
fluorine-based surfactant: 5 wt %

Here, "HDDA" is 1,6 hexane diol diacrylate, and the HDDA was manufactured by Daicel UPC, Co., Ltd. "DPCA60" is caprolactone-modified dipentaerythritol hexaacrylate, and the DPCA60 (Kayarad DPCA60) was manufactured by Nihon Kayaku Co., Ltd.

The polymerizable compounds (HDDA and DPCA60) and the pigment make up the liquid A1, and the sum of content ratios of these ingredients is 100 wt %. The polymerizable compounds (HDDA and DPCA60) and the diffusion inhibitor (fluorine-based surfactant) make up the liquid B1, and the sum of content ratios of these ingredients is 100 wt %.

In the comparative examples (conditions 1 and 2) in which ultraviolet light is radiated as the curing radiation, Irg 1870 (manufactured by Ciba Specialty Chemicals Co. Ltd.) of 15 wt % was added to the liquid B1 (treatment liquid) having the composition described above, as a polymerization initiator. In the comparative examples using a one-liquid system (conditions 3 to 8), only the liquid A1 (ink) was used.

Next, the experimental methodology is described below.

Firstly, the liquid B1 was applied as a treatment liquid on the recording medium, to a film thickness of approximately 5 μm, by using a bar coater. OHP film made of polyethylene terephthalate (PET), into which ink does not permeate, was used as the recording medium. Thereupon, an image was recorded on the recording medium by ejecting droplets of the liquid A1 as ink (at a liquid droplet volume of approximately 6 pl) onto the recording medium, by using an inkjet head. Thereupon, a curing radiation (ultraviolet (UV) light in conditions 1 and 2, or an electron beam (EB) in conditions 3 to 14) was radiated onto the recording medium on which the image had been recorded. In the cases of conditions 3 to 14 (in the cases where the electron beam was used for the radiation), the electron beam was radiated on the recording medium at the corresponding acceleration voltages within the range of 30 kV to 70 kV. A vacuum tube type of low-voltage electron beam irradiation device was used, at an irradiation dose of 30 kGy, and the irradiation was carried out in a nitrogen gas atmosphere. Irradiation was carried out in a perpendicular direction with respect to the recording surface of the recording medium.

Next, the evaluation criteria are described below.

For the conditions 1 to 14 in FIG. 8, evaluations were carried out in terms of the four evaluation items: "curing characteristics", "prevention of depositing interference", "suppression of dot expansion" and "movement of gravity center of dot".

In order to evaluate the "curing characteristics", a rubbing test (rubbing the printed surface with art paper and observing the level of ink transfer to the art paper) was carried out on the print sample after irradiated with the radiation (electron beam or ultraviolet light). The ink transfer to the art paper was observed with a microscope and was then evaluated and categorized into the following states: "good", "average" and "poor". The symbol "good" indicates that there is virtually no color transfer, the symbol "average" indicates that some color transfer was observed when viewed in detail with a microscope, and the symbol "poor" indicates color transfer of a level that is clearly visible upon visual observation.

The other evaluation items, "prevention of depositing interference", "suppression of dot expansion" and "movement of gravity center of dot", were evaluated by capturing microscopic photographs of the print sample.

The "prevention of depositing interference" was evaluated by observing the situation of unification between mutually adjacent dots, and was categorized into two states: "good" and "poor". The symbol "good" indicates that the dots were independent, and the symbol "poor" indicates that unification of the dots was observed.

The "suppression of dot expansion" was evaluated by measuring the dot diameter, and was categorized into three states: "good", "average" and "poor". The symbol "good" indicates that the measured diameter was 50 μm or less, the symbol "average" indicates that the measured diameter was greater than 50 μm and less than 80 μm, and the symbol "poor" indicates that the measured diameter was 80 μm or above.

The "movement of gravity center of dot" was evaluated by measuring the displacement of the dot position from the target (intended) depositing position, and was categorized into the following states: "good", "average" and "poor". The symbol "good" indicates that the measured displacement was 50 μm or less, the symbol "average" indicates that the measured displacement was greater than 50 μm and less than 80 μm, and the symbol "poor" indicates that the measured displacement was 80 μm or above.

As shown in FIG. 8, in the case of a two-liquid system using electron beam irradiation (conditions 9 to 14), if the acceleration voltage of the electron beam was in the range of 40 kV to 60 kV (conditions 10, 11 and 12), then good results (indicated by the symbol of "good") were obtained for all of the evaluation items: "curing characteristics", "prevention of depositing interference", "suppression of dot expansion", and "movement of gravity center of dot".

Practical Example 2

Experiments were carried out under conditions shown in FIG. 9, in order to determine the appropriate relationship between the surface tension of the ink and the surface tension of the treatment liquid, in the case where two liquids, namely, liquid A (ink) and liquid B (treatment liquid), were deposited on the recording medium and the electron beam was used as curing radiation.

In FIG. 9, conditions 1, 4 and 5 relate to comparative examples, and conditions 2, 3 and 6 relate to practical examples of the present invention.

In practical example 2, liquids A1 and A2 were prepared as the ink, and liquids B2, B3 and B4 were prepared as the treatment liquid. The compositions of the liquids A1, A2, B2, B3, and B4 are as follows.

Liquid A1: (surface tension 34.4 mN/m)
bifunctional monomer (HDDA): 92 wt %,
hexafunctional monomer (DPCA60): 5 wt %,
pigment: 3 wt %
Liquid A2: (surface tension 31.2 mN/m)
bifunctional monomer (HDDA): 91.95 wt %,
hexafunctional monomer (DPCA60): 5 wt %,
pigment: 3 wt %
fluorine-based surfactant: 0.05 wt %
Liquid B2: (surface tension 36.3 mN/m)
bifunctional monomer (HDDA): 97 wt %,
hexafunctional monomer (DPCA60): 3 wt %,
Liquid B3: (surface tension 32.5 mN/m)
bifunctional monomer (HDDA): 96.95 wt %,
hexafunctional monomer (DPCA60): 3 wt %,
fluorine-based surfactant: 0.05 wt %
Liquid B4: (surface tension 28.1 mN/m)
bifunctional monomer (HDDA): 96.9 wt %,
hexafunctional monomer (DPCA60): 3 wt %,
fluorine-based surfactant: 0.1 wt %

The static surface tension at a measurement temperature of 25° C. was measured using a CBVP-Z surface tensionometer manufactured by Kyowa Interface Science Co., Ltd.

Similarly to the experiments in practical example 1, firstly, one of the liquids B2, B3 and B4 was applied on the recording medium (an OHP film made of PET) as a treatment liquid, to a film thickness of approximately 5 μm, using a bar coater. Thereupon, an image was recorded on the recording medium by ejecting droplets of one of liquids A1 and A2 as ink (at a liquid droplet volume of approximately 6 pl) on the recording medium, by using an inkjet head. Subsequently, an electron beam was radiated on the recording medium on which an image had been recorded, at an acceleration voltage of 50 kV.

A low-voltage electron beam irradiation device of vacuum tube type was used, at an irradiation dose of 30 kGy, and irradiation was carried out in a nitrogen gas atmosphere. Irradiation was carried out in a perpendicular direction with respect to the recording surface of the recording medium.

Next, the evaluation criteria are described below.

For the conditions 1 to 6 in FIG. 9, evaluations were carried out in terms of the four evaluation items: "curing characteristics", "prevention of depositing interference", "suppression of dot expansion" and "movement of gravity center of dot". The details of these evaluation items is described above in practical example 1 and therefore description thereof is omitted here.

As shown in FIG. 9, when the surface tension γA of the ink and the surface tension γB of the treatment liquid have the relationship of γA>γB, good results (indicated by the symbol "good") were obtained for all of the evaluation items: "curing characteristics", "prevention of depositing interference", "suppression of dot expansion" and "movement of gravity center of dot".

As a result of these various evaluations, it can be seen that if the surface tensions do not have the preferable relationship (in other words, if the surface tensions have a relationship of γA≦γB), then the dots instantly spread to a large extent, immediately after deposition, and when the electron beam is radiated, the dots are already in a broadly spread state, and hence the image quality is degraded. Therefore, if the surface tensions do not have the preferable relationship (in other words, if the surface tensions have a relationship of γA≦γB), then whatever the acceleration voltage of the electron beam, it is not possible to restrict the dot expansion to a satisfactory range. Conversely, it can be seen readily that if the surface tensions have the preferable relationship (in other words, if the surface tensions have a relationship of γA>γB), then the dot diameter is in a restricted state within a satisfactory range when the electron beam is radiated, and therefore provided that the electron beam irradiation conditions are conditions (in other words, conditions where the acceleration voltage of the electron beam is no more than 60 kV) which do not have adverse effects on the suppression of dot expansion or the suppression of movement of gravity center of dot, the extent of dot expansion and movement of gravity center of dot is restricted within a satisfactory range. In other words, in a two-liquid system aimed at preventing the depositing interference, provided that the surface tensions have the relationship of γA>γB, then if the acceleration voltage of the electron beam is set to any voltage in the range of 40 kV to 60 kV, good results are obtained in terms of curing characteristics, prevention of depositing interference, suppression of dot expansion and suppression of movement of gravity center of dot, and therefore it is possible sufficiently to suppress the degradation of the image quality.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus which forms an image on a recording medium by applying a first liquid containing coloring material and a second liquid containing no coloring material or the coloring material of not greater than 0.1 wt %, on the recording medium, the inkjet recording apparatus comprising:

a liquid application device which applies the second liquid on the recording medium and then ejects droplets of the first liquid toward the second liquid applied on the recording medium; and an electron beam irradiation device which radiates an electron beam on the first liquid and the second liquid on the recording medium, wherein:

at least one of the first liquid and the second liquid contains a polymerizable compound which is polymerized when irradiated with the electron beam; and the electron beam irradiation device radiates the electron beam at an acceleration voltage of 40 kV through 60 kV.

2. The inkjet recording apparatus as defined in claim 1, wherein a surface tension γA of the first liquid and a surface tension γB of the second liquid have a relationship of γA>γB.

3. The inkjet recording apparatus as defined in claim 1, wherein solvent contents in the first liquid and the second liquid are not greater than 1 wt %.

4. An inkjet recording apparatus which forms a transfer image on an intermediate transfer body by applying a first liquid containing coloring material and a second liquid containing no coloring material or the coloring material of not greater than 0.1 wt %, on the intermediate transfer body, and which transfers the transfer image to a recording medium, the inkjet recording apparatus comprising:

a liquid application device which applies the second liquid on the intermediate transfer body and then ejects droplets of the first liquid toward the second liquid applied on the intermediate transfer body; and an electron beam irradiation device which radiates an electron beam on the first liquid and the second liquid on the intermediate transfer body, wherein:

at least one of the first liquid and the second liquid contains a polymerizable compound which is polymerized when irradiated with the electron beam; and the electron beam irradiation device radiates the electron beam at an acceleration voltage of 40 kV through 60 kV.

5. The inkjet recording apparatus as defined in claim 4, wherein a surface tension γA of the first liquid and a surface tension γB of the second liquid have a relationship of γA>γB.

6. The inkjet recording apparatus as defined in claim 2, wherein solvent contents in the first liquid and the second liquid are not greater than 1 wt %.

* * * * *